US008143972B2

(12) United States Patent
Shiokawa et al.

(10) Patent No.: US 8,143,972 B2
(45) Date of Patent: Mar. 27, 2012

(54) RESONATOR AND FILTER

(75) Inventors: Noritsugu Shiokawa, Kanagawa (JP); Hiroyuki Kayano, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 282 days.

(21) Appl. No.: 12/564,148

(22) Filed: Sep. 22, 2009

(65) Prior Publication Data

US 2010/0079221 A1 Apr. 1, 2010

(30) Foreign Application Priority Data

Sep. 26, 2008 (JP) ..... 2008-247368

(51) Int. Cl.
*H01P 1/203* (2006.01)
*H01P 7/08* (2006.01)
*H01B 12/02* (2006.01)

(52) U.S. Cl. ..... 333/204; 333/99 S; 505/210

(58) Field of Classification Search ..... 333/203–205, 333/219, 99 S; 505/210
See application file for complete search history.

(56) References Cited

U.S. PATENT DOCUMENTS 4,721,931 A * 1/1988 Nishikawa et al. ..... 333/203
6,130,189 A * 10/2000 Matthaei ..... 505/210
6,144,268 A 11/2000 Matsui et al.
7,181,259 B2 * 2/2007 Tsuzuki et al. ..... 505/210
7,965,158 B2 * 6/2011 Soora ..... 333/204
2003/0222731 A1 12/2003 Raihn et al.

FOREIGN PATENT DOCUMENTS

| | | |
|---|---|---|
| JP | 08-321706 | 12/1996 |
| JP | 11-177310 | 7/1999 |
| JP | 2002-507359 | 3/2002 |
| WO | 9900897 | 1/1999 |

OTHER PUBLICATIONS

Japanese Office Action dated Feb. 1, 2011 corresponding to U.S. Appl. No. 12/564,148, filed Sep. 22, 2009.

* cited by examiner

*Primary Examiner* — Seungsook Ham
(74) *Attorney, Agent, or Firm* — Turocy & Watson, LLP

(57) ABSTRACT

The present invention provides a resonator and a filter that reduce the resonator radiation loss so as to achieve a high Q value that is inherent to a low-loss material while maintaining high power handling capability. In this manner, both high power handling capability and a high Q value can be achieved at the same time. The resonator is a microstripline structure and includes a line structure formed with resonance lines in which current standing waves are generated in a resonant state in a line, and currents in each two adjacent lines flow in the opposite directions from each other, and a connection line that connects the resonance lines at the portions having in-phase voltages among the nodes of the current standing waves of the resonance lines in the resonant state. The filter includes resonators of the same type as the above resonator.

6 Claims, 18 Drawing Sheets

RESONATOR AND FILTER

CROSS-REFERENCE TO RELATED APPLICATION

This application is based upon and claims the benefit of priority from Japanese Patent Application No. 2008-247368, filed on Sep. 26, 2008, the entire contents of which are incorporated herein by reference.

FIELD OF THE INVENTION

The present invention relates to a resonator and a filter that are used in devices involving microwaves, such as broadcasting equipments, communication equipments, and measuring equipments.

BACKGROUND OF THE INVENTION

One of the simplest forms of microwave resonators having microstripline structures is a resonator that is formed with conductor striplines each having an electrical length of a half wavelength (180 degrees) or an electrical length integral-number times as large as a half wavelength in resonance frequency, and a dielectric substrate and a conductor ground plate. This resonator resonates in a mode in which currents flow along the striplines. In a resonant state, the current density distribution concentrates mostly at each edge portion of the striplines. This tendency becomes more remarkable as the frequency becomes higher.

In a case where a resonator of the above type is used as a microwave resonator for high-power signals of 1 W or greater, for example, the current concentration at each edge portion of the striplines hinders achievement of high power handling capability. This is because the high current density at the edge portions exceeds the allowable current density of the conductive material, and the electrical conducting properties of the conductive material are degraded. If the striplines are made of a superconducting material, for example, this phenomenon is observed, as the current density at the edge portions exceeds the critical current density of the superconducting material.

Along with the power handling capability, the Q value is another important element in the characteristics of a resonator. The Q value of a resonator represents the sharpness of the resonance peak on the frequency domain, and is determined by the resonator loss caused by various factors, such as conductor loss, dielectric loss, and radiation loss. When the loss is small, the Q value is high. In a frequency filter device such as a low-pass filter, a high-pass filter, or a bandpass filter that is formed with resonators, sharper cutoff characteristics and smaller insertion loss are achieved when the Q value of each resonators is higher. Therefore, resonators having high Q values are often demanded.

If the dominant loss factor that determines the Q value of a resonator of the above type is conductor loss, the current concentration at the edge portions of the striplines also becomes a problem. Due to the current concentration, the effective cross-sectional area of the striplines becomes smaller, and the resistance becomes higher. As a result, the conductor loss becomes greater, and the Q value becomes lower. There are cases where the electrical resistance at the current concentrating portion becomes higher, and the conductor loss becomes greater, resulting in a lower Q value.

As a technique for reducing the current concentration at the edge portions of the striplines, JP-A-H8-321706 (KOKAI) discloses a technique by which slits are formed at regular intervals along the lines in the entire linear stripline unit. As an improved version of this method, JP-A-H11-177310 (KOKAI) discloses a technique by which one or more slits are formed along the striplines only at the edge portions of the striplines.

SUMMARY OF THE INVENTION

A resonator according to a first aspect of the present invention is a resonator of a microstripline structure including a line structure that includes: resonance lines in which current standing waves are generated in a resonant state in a line, and currents in each two adjacent lines flow in the opposite directions from each other; and a connection line that connects the resonance lines at the portions that have in-phase voltages among the nodes of the current standing waves in the resonance lines in the resonant state.

A resonator according to a second aspect of the present invention is a resonator of a microstripline structure including a single line structure that includes: resonance lines of substantially the same shape having an electrical length approximately odd-number times as large as 180 degrees in resonance frequency; and a connection line that connects the resonance lines to one another at the portions that are geometrically equivalent to one another and each have an electrical length approximately integral-number times as large as 180 degrees in resonance frequency from an end portion of the each resonance lines. The line structure includes three or more of the resonance lines, and the resonance lines each have a hairpin-like shape formed with two substantially parallel linear portions connected by a bent portion. The connection line has a ring-like shape or a disk-like shape. The resonance lines are connected to the connection line in a radial fashion with respect to the center of gravity of the connection line.

A resonator according to a third aspect of the present invention is a resonator of a microstripline structure having line structures each including: resonance lines of substantially the same shape having an electrical length approximately integral-number times as large as 180 degrees in resonance frequency; and a connection line that connects the resonance lines to one another at the portions that are geometrically equivalent to one another and each have an electrical length approximately integral-number times as large as 180 degrees in resonance frequency from the end portion of the each resonance lines. Each of the line structures includes three or more of the resonance lines, and at least one of the resonance lines of one of the line structures is placed along at least one of the resonance lines of another one of the line structures.

A resonator according to a fourth aspect of the present invention is a resonator of a microstripline structure including a first line structure and a second line structure that have different shapes from each other. The first line structure includes: linear resonance lines that have an electrical length of 360 degrees or greater in resonance frequency and are arranged parallel to one another; and a connection line that connects the resonance lines at the portions that are geometrically equivalent to one another and has an electrical length approximately integral-number times as large as 180 degrees in resonance frequency from each end portion of each the resonance lines. The second line structure includes: linear resonance lines that are placed one by one in substantially a parallel fashion between each two adjacent resonance lines of the resonance lines of the first line structure, and each have an electrical length approximately integral-number times as large as 180 degrees in resonance frequency; and a connection line that connects the end portions of the linear resonance lines each having the electrical length approximately integral-number times as large as 180 degrees in resonance frequency, and surrounds the first line structure.

A filter according to a fifth aspect of the present invention includes the resonator of one of the above resonators of the aspects.

DETAILED DESCRIPTION OF THE EMBODIMENTS

Figure 1:
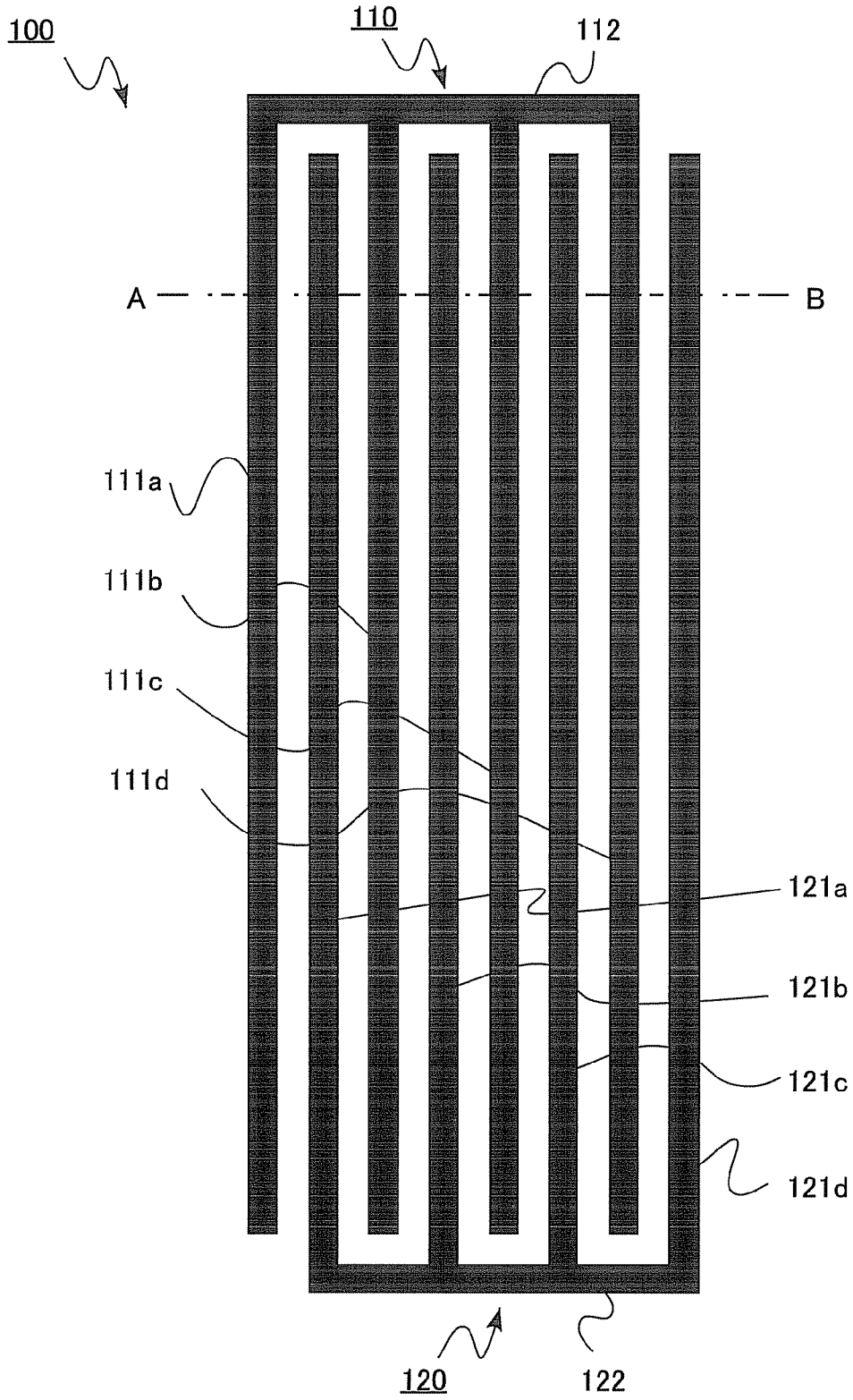
FIG. 1 is a plan view of the stripline pattern of a resonator of a first embodiment.

The following is a description of resonators and filters as embodiments of the present invention, with reference to the accompanying drawings. In this specification, striplines that have current standing waves generated therein in a resonant state of a resonator are referred to as resonance lines. A stripline that connects resonance lines to one another are referred to as a connection line. Each structure that is formed with resonance lines and connection lines and is physically integrated is referred to as a line structure. In this specification, "currents flowing in the opposite directions" in each two adjacent lines means that "the phases of currents being opposite to each other" in each two adjacent lines. Also, in this specification, an integer is 0 or a positive integer.

When transmission lines forming a microstripline structure are used as a resonator, both high power handling capability and a high Q value might be required. For example, both high power handling capability and a high Q value are required in a case where such a resonator is used in a bandpass filter in a transmitting device for communications and broadcasting. In such fields, high power handling capability is required to endure the high power for transmitting, and a high Q value is required to achieve low-loss, sharp cutoff characteristics.

If the dominant loss factor that determines the Q value of a resonator is conductor loss, the above mentioned techniques disclosed in JP-A-H8-321706 (KOKAI) and JP-A-H11-177310 (KOKAI) are effective. By forming slits in the striplines, both the power handling capability and the Q value can be improved, compared with the power handling capability and the Q value obtained in a case where slits are not formed.

However, those techniques are not effective, if the resistance value of the conductive material forming the striplines is low, and the dominant loss factor that determines the Q value of the resonator is not conductor loss. For example, in a case where the conductor portions (the striplines and the ground plate) of the transmission lines of a microstripline structure are made of a material having a low resistance value and small conductor loss like a superconducting material, and the dielectric substrate is made of a material having small dielectric loss like sapphire, the dominant loss factor that determines the Q value of the resonator is radiation loss. If the conductor loss is reduced in such a case, the increase in the Q value is very small. Unless the radiation loss is reduced, it is impossible to take advantage of the low-loss characteristics of a conductor and a dielectric material.

First Embodiment

A resonator of a first embodiment of the present invention is a resonator of a microstripline structure, and includes a line structure that is formed with resonance lines in which current standing waves are generated in the lines in a resonant state, and the currents in each two adjacent lines flow in the opposite directions from each other, and a connection line that connects the resonance lines at the portions having in-phase voltages among the nodes of the current standing waves of the resonance lines in the resonant state.

As will be described later in detail, the resonator of this embodiment can achieve high power handling capability, by having a pluarity of resonance lines. Furthermore, the resonator of this embodiment can reduce radiation loss and achieves a high Q value, as current standing waves are generated in the lines in a resonant state, and the currents in each two adjacent lines flow in the opposite directions from each other.

The resonator of this embodiment includes two line structures. Each of the two line structures is formed with resonance lines of substantially the same shape each having an electrical length of approximately 180 degrees in resonance frequency, and a connection line that connects the resonance lines to one another at the portions that are geometrically equivalent to one another and have an electrical length of approximately 180 degrees in resonance frequency from one end of each resonance line, or at the portions equivalent to the other ends of the resonance lines.

Each of the line structures includes three or more resonance lines. At least one of the resonance lines of one of the line structures is placed along at least one of the resonance lines of the other one of the line structures. In this specification, the portions geometrically equivalent to one another in the resonance lines are the end portions on the same side of the line structures having substantially the same shape, or the portions located at the same distance from one end portion of each corresponding one of the resonance lines.

More specifically, the two line structures have substantially the same comb-like shapes in which end portions of linear resonance lines of the same shape are connected by a linear connection line. The two line structures are combined in such a manner that the two comb-like shapes face each other, and the resonance lines of one of the line structures and the resonance lines of the other one of the line structures are alternately located.

FIG. 1 is a plan view of a stripline pattern of the resonator of this embodiment. As shown in FIG. 1, the resonator 100 includes two comb-shaped line structures 110 and 120. The two line structures 110 and 120 are electromagnetically coupled to each other, so as to function as one resonator.

The line structure 110 includes four linear resonator lines 111*a* through 111*d*. Those resonator lines 111*a* through 111*d* have an electrical length of approximately 180 degrees of resonance frequency. The resonance lines 111*a* through 111*d* are connected at one end by a connection line 112.

In a resonant state, current standing waves are generated in the resonance lines 111*a* through 111*d*, because of a resonance phenomenon that causes current waves to reciprocate in phase in the resonance lines.

The connected end portions of the resonance lines 111*a* through 111*d* are open to the ground, and therefore, serve as the nodes for the current standing waves in a resonant state, and the voltages are in phase. If there are no connections, there exist the same numbers of resonance modes as the number of resonance lines. As the resonance lines 111*a* through 111*d* are connected by the connection line 112, only the resonance mode in which the voltages at the end portions are in phase or the currents flow in the same direction remains in the respective resonance lines 111*a* through 111*d*.

The line structure 120 is also formed with four linear resonance lines 121*a* through 121*d*, and a connection line 122. In the line structure 120, the same current standing waves as those generated in the line structure 110 are also generated in a resonant state.

The line structure 110 and the line structure 120 are combined so that the resonance lines 111*a* through 111*d* of the line structure 110 and the resonance lines 121*a* through 121*d* of the line structure 120 are alternately located. More specifically, the line structure 110 and the line structure 120 are combined in a nested fashion, so that the comb-shaped portions face each other. When current standing waves are generated in the lines in a resonant state in the resonator 100, there are a reverse-direction resonance mode in which the current in the resonance line 111*a* flows in the opposite direction from the flowing direction of the current in the resonance line 121*a*, and a forward-direction resonance mode in which the currents flow in the same direction. In this embodiment, the reverse-direction resonance mode is used.

Figure 2:
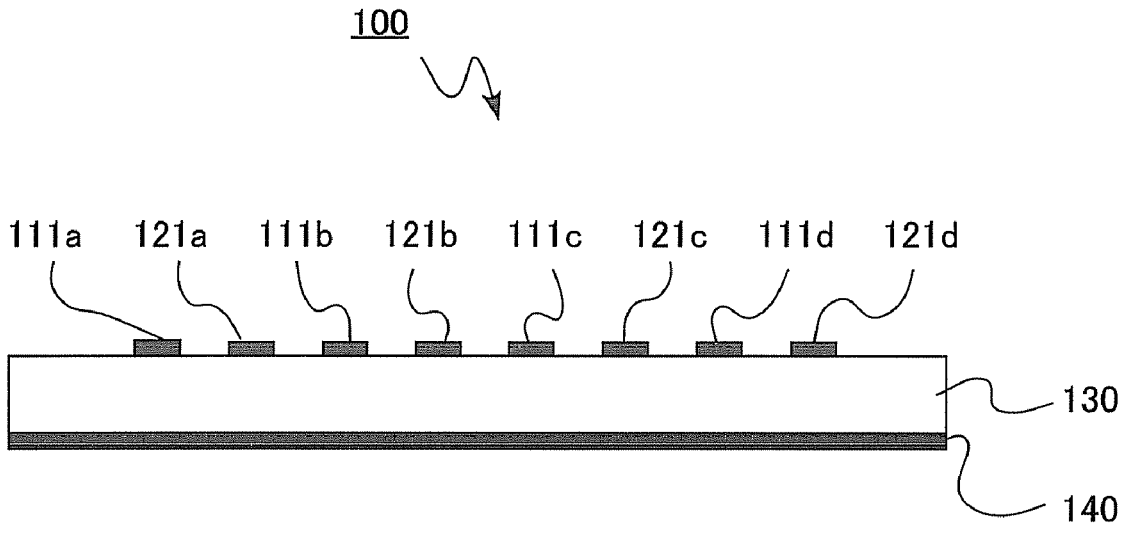
FIG. 2 is a cross-sectional view of the resonator, taken along the line A-B of FIG. 1.

FIG. 2 is a cross-sectional view of the resonator, taken along the line A-B of FIG. 1. The resonance lines 111*a* through 111*d* and 121*a* through 121*d* are formed on the upper face of a dielectric substrate 130. A ground plane 140 made of a conductive material is formed on the lower face of the dielectric substrate 130. The resonator 100 has this microstripline structure.

Here, it is desirable that the resonance lines 111*a* through 111*d* and 121*a* through 121*d*, the connection lines 112 and 122, and the ground plane 140 are made of a superconductive material such as YBCO, so as to reduce conductor loss. The dielectric substrate 130 is made of sapphire or MgO, for example, so as to reduce dielectric loss.

Figure 3:
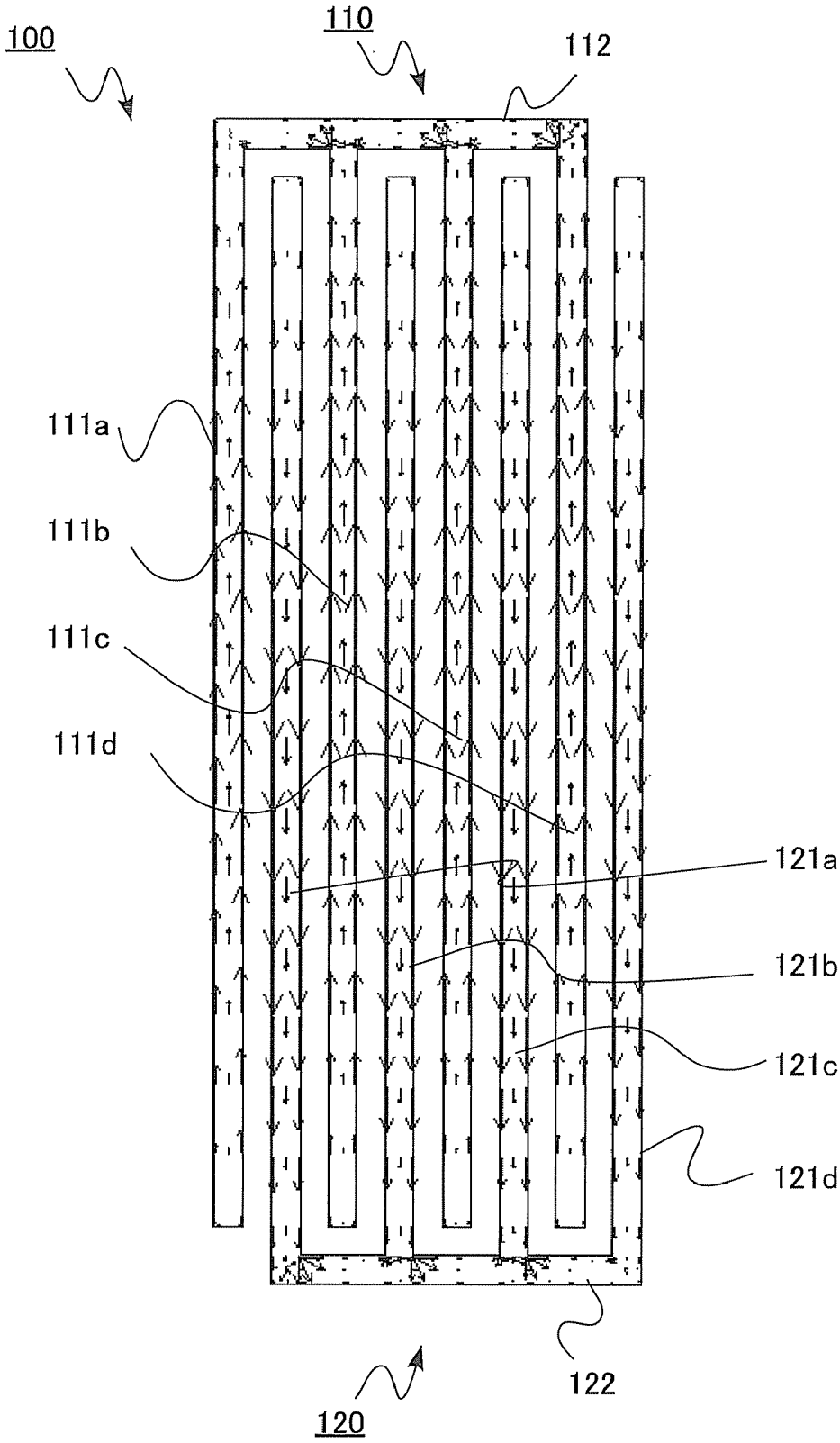
FIG. 3 shows the results of an electromagnetic simulation performed to check the current distribution in a resonant state of the resonator of the first embodiment.

FIG. 3 shows the result of an electromagnetic field simulation performed to check the current distribution in a resonant state in the resonator of this embodiment. In FIG. 3, the length of each arrow represents the magnitude of the current, and the orientation of each arrow represents the direction of the current. Current standing waves that use the center portions of the respective resonance lines as antinodes and use both ends of each resonance line as nodes are generated in the resonance lines 111*a* through 111*d* and 121*a* through 121*d*. Currents flowing in the opposite directions from each other are generated in each two adjacent lines of the resonance lines: 111*a* and 121*a*, 121*a* and 111*b*, 111*b* and 121*b*, 121*b* and 111*c*, 111*c* and 121*c*, 121*c* and 111*d*, and 111*d* and 121*d*.

The connection lines 112 and 122 are connected to the current standing-wave nodes of the resonance lines 111*a* through 111*d* and 121*a* through 121*d*, respectively. The connection lines 112 and 122 connect portions having in-phase voltages to one another, judging from the directions of the currents. The voltage at the connecting portions of the connection line 112 and the connecting portions of the connection line 122 are in phase.

Distribution of the currents flowing at the conductive portions of the resonator in a resonant state to all the conductors forming the resonator, contributes to provide high power handling capability to the resonator of a microstripline structure. This is because the electrical conducting properties of the conductive material deteriorate when the maximum current density of the conductive portions of the resonator exceeding the allowed current density of the conductive material, and the power handling capability of the resonator reaches its limit. It is obvious that the currents should not concentrate at a certain point of the conductive material but should be distributed around the entire conductive material, so as to lower the maximum current density.

The resonator 100 of this embodiment has resonator lines The conductive portion having the highest current density among the conductive portions of a resonator is normally the edge portion of each stripline. In this embodiment, a larger number of resonance lines are employed, and the resonance mode in which the currents in each two adjacent resonance lines flow in the opposite directions from each other is used so as to distribute the currents to the resonance lines. In this manner, the maximum current density can be lowered, and the power handling capability of the resonator can be improved.

To reduce the radiation loss of a microstripline resonator, the currents flowing in the striplines in a resonant state should be distributed in such a manner that currents flowing in the opposite directions from each other are adjacent to each other. This is because adjacent currents flowing in the opposite directions from each other cancel the radiation magnetic field of each other, to restrict the energy release to the outside of the resonator. Like the resonator 100 of this embodiment, a resonator that has currents generated in the opposite directions from each other in each two adjacent resonance lines in a resonant state can reduce the radiation loss.

As described above, in the resonator 100 of this embodiment, the currents flowing in the resonator are distributed to the resonance lines, so as to achieve high power handling capability. The radiation loss is also reduced by the currents flowing in the opposite directions from each other in each two adjacent lines. In this manner, the high Q value, which is inherent to a low-loss material, is achieved. Thus, it becomes possible to achieve both high power handling capability and a high Q value.

Next, the results of evaluations made on the power handling capability and the Q value of the resonator 100 having the structure illustrated in FIGS. 1 and 2 are described. In the resonator 100, the resonance frequency is 5350 GHz, the line width of each of the resonance lines is 0.3 mm, the line width of each of both connection lines is 0.3 mm, the distance between each two adjacent resonance lines is 0.3 mm, and the lengths of all the resonance lines are the same.

The resonator 100 is formed by patterning the YBCO superconductive thin film on the sapphire substrate. After the resonator 100 is cooled by a refrigerator, the power handling capability and the Q value are evaluated. The sine wave generated by a signal generator is amplified by an amplifier, and is then input to a resonator having an external Q value of approximately 2000. The power handling capability is evaluated with such a power that the difference between the input power and the output power is 1 dB or greater in this case. As for the Q value, the frequency characteristics between the input and output of a weak coupled resonator are measured with the use of a network analyzer, and a unloaded Q value is estimated from the measurement result. The results show that the power handling capability is 13 W, and the Q value is 36000. A Q value derived from radiation loss is calculated through an electromagnetic field simulation, to obtain the value of 91000.

Figure 17:
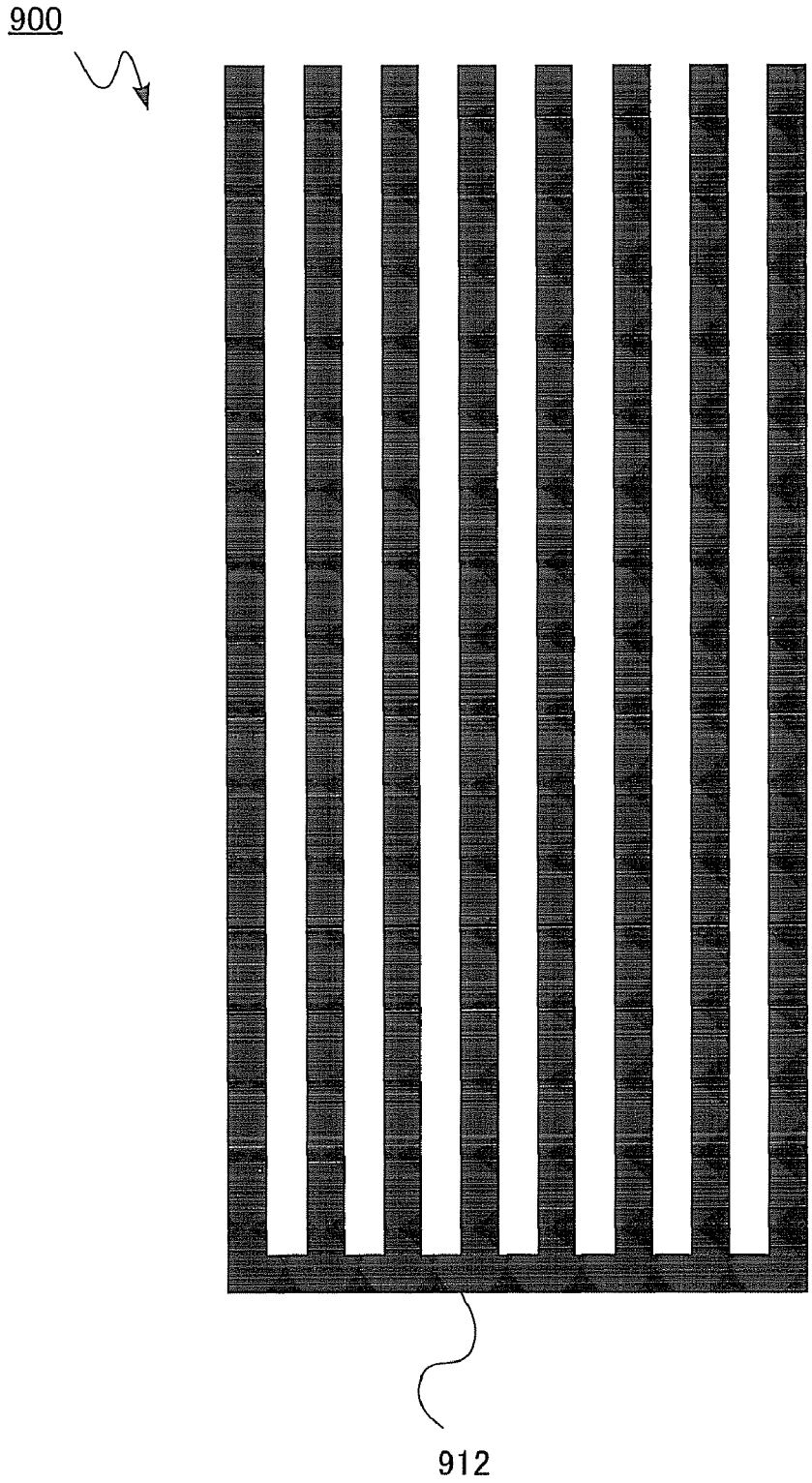
FIG.17 RELATED ART
FIG. 17 is a plan view of the stripline pattern of a conventional resonator.

FIG. 17 is a plan view of a stripline pattern of a conventional resonator. To compare above results with the results from a conventional resonator having slits, the resonator shown in FIG. 17 is manufactured in the same manner as above, and the power handling capability and the Q value are evaluated. To make a comparison under impartial conditions, the resonator 900 shown in FIG. 17 has a resonance frequency of 5350 GHz, like the resonator 100, and has 0.3-mm line widths and 0.3-mm line intervals, like the resonator 100. The total number of lines is eight, which is also the same as the total number of lines in the resonator 100. One end of the resonator 900 is short-circuited by a connection line 912, so as to eliminate unnecessary resonance modes.

Figure 18:
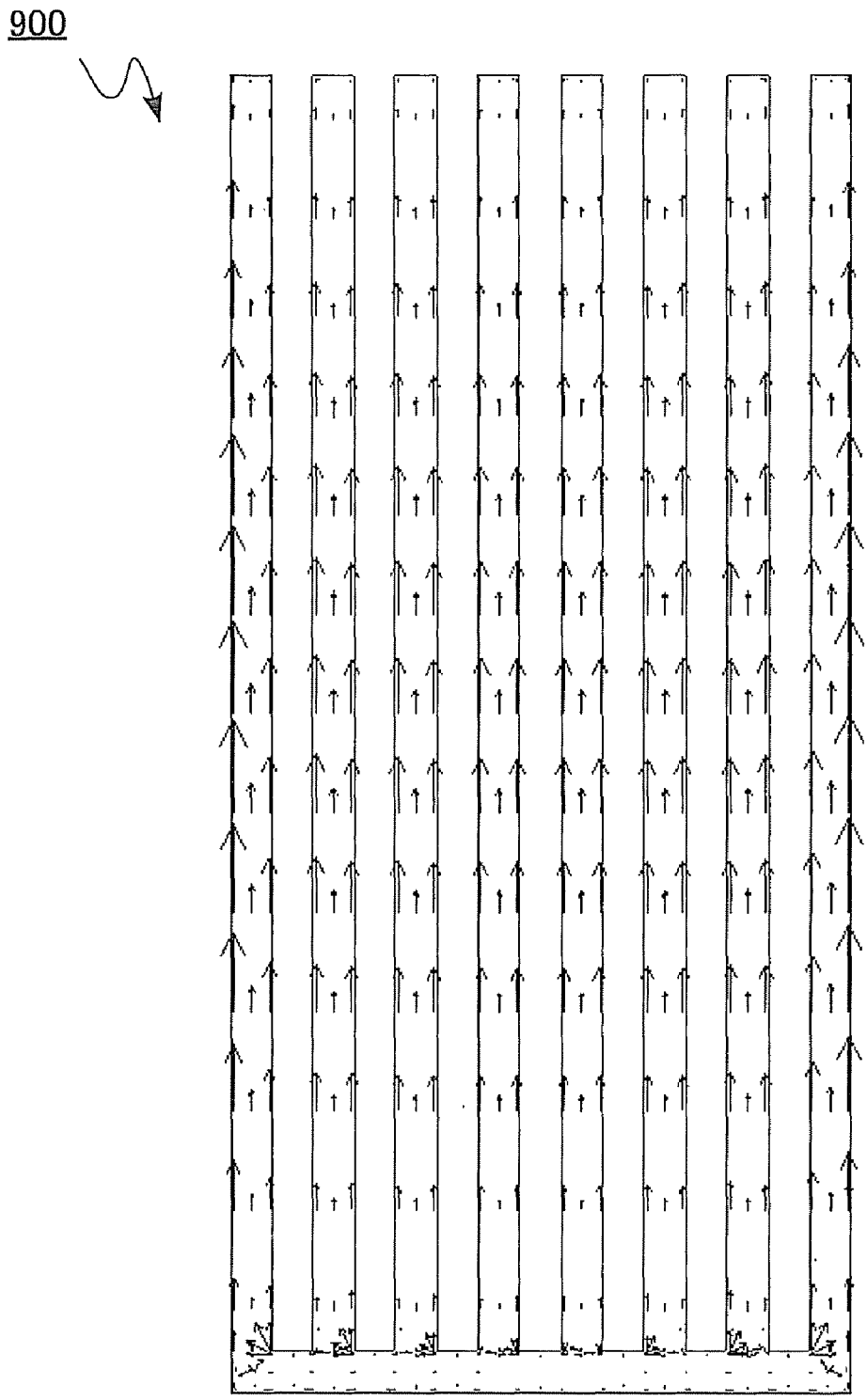
FIG.18 RELATED ART
FIG. 18 shows the results of an electromagnetic simulation performed to check the current distribution in a resonant state of the conventional resonator.

FIG. 18 shows the results of an electromagnetic field simulation performed to check the current distribution in a resonant state of the resonator shown in FIG. 17. Currents flowing in the same direction are generated in each two adjacent resonance lines. The results of evaluations made in the same manner as in the resonator 100 show that the power handling capability is 10 W, and the Q value is 330. A Q value derived from radiation loss is calculated through an electromagnetic field simulation, to obtain the value of 340.

The result of the comparison between the two resonators shows that the resonator 100 of this embodiment makes its radiation loss much smaller than the radiation loss in the related art, while maintaining high power handling capability. Accordingly, the Q value is 36000, which is more than one hundred times as high as 330. Thus, the resonator 100 of this embodiment can achieve both high power handling capability and a high Q value.

Second Embodiment

A resonator of a second embodiment of the present invention is a resonator of a microstripline structure, and is the same as the resonator of the first embodiment in having a line structure that is formed with resonance lines having current standing waves generated in the lines in a resonant state and having currents flowing in the opposite directions from each other in each two adjacent lines, and a connection line that connects the resonance lines at the portions having in-phase voltages among the nodes of the current standing waves of the resonance lines in a resonant state. The microstripline structure and the actions and effects of the resonator are the same as those of the first embodiment, and therefore, explanation of them is omitted herein.

The resonator of this embodiment has a single line structure that is formed with resonance lines of substantially the same shapes having an electrical length odd-number times as large as 180 degrees in terms of resonance frequency, and a connection line that connects the resonance lines to one another at the portions that are geometrically equivalent to one another and each have an electrical length approximately integral-number times as large as 180 degrees from the end portion of the resonance line in terms of resonance frequency. The line structure includes three or more resonance lines, and each of the resonance lines has a hairpin-like shape formed with two substantially parallel linear portions connected by a bent portion. The connection line has a ring-like or disk-like shape, and the resonance lines are connected to the connection line in a radial fashion with respect to the center of gravity (or centroid or geometric center) of the connection line.

Figure 4:
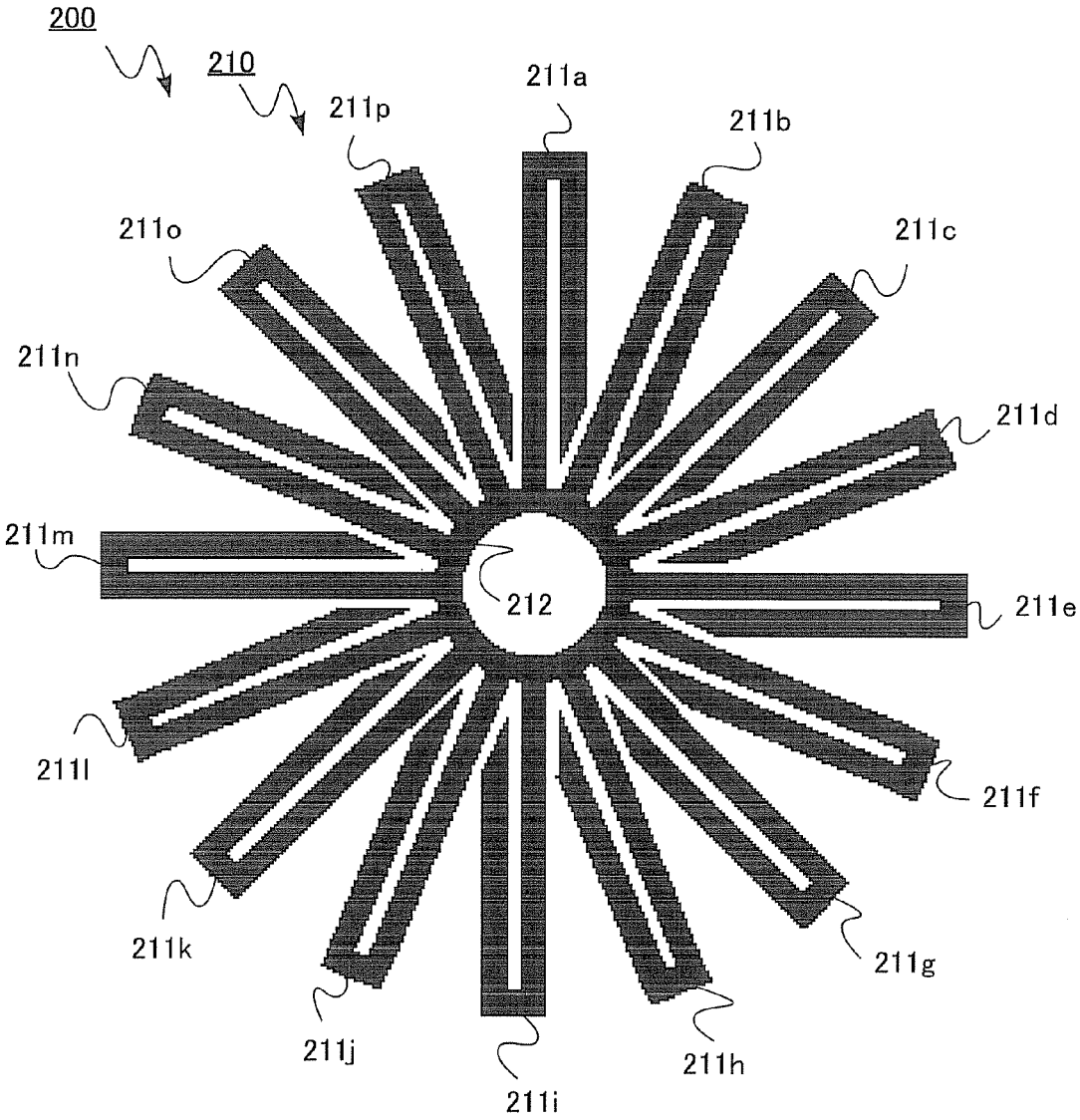
FIG. 4 is a plan view of the stripline pattern of a resonator of a second embodiment.

FIG. 4 is a plan view of the stripline pattern of the resonator of this embodiment. As shown in FIG. 4, the resonator 200 has a single line structure 210.

The line structure 210 includes sixteen resonance lines 211*a* through 211*p*. Each of the resonance lines 211*a* through 211*p* has a hairpin-like shape formed with two substantially parallel linear lines connected by a bent portion. Each of the resonance lines 211*a* through 211*p* has an electrical length of 180 degrees in resonance frequency.

One end of each of the resonance lines 211*a* through 211*p* or each of the portions geometrically equivalent to one another is connected to the others by a ring-like connection line 212. The resonance lines 211*a* through 211*p* are connected to one another in a radial fashion with respect to the center of gravity of the connection line 212. Between each two adjacent resonance lines, the angle formed by geometrically equivalent portions is almost the same.

The connected end portions of the resonance lines 211*a* through 211*p* are open to the ground, and therefore, serve as the nodes of current standing waves in a resonant state. Accordingly, the voltages to be judged from the directions of currents are in phase. Although the connection line 212 has a ring-like shape here, the connection line 212 may have a disk-like shape instead.

In the resonator 200 of this embodiment, each of the resonance lines has a hairpin-like shape having an electrical length approximately odd-number times as large as 180 degrees in resonance frequency. Accordingly, when current standing waves are generated in the lines in a resonant state, the currents in each two adjacent lines flow in the opposite directions from each other. For example, the lines of the resonance line 211*a* connected by a bent portion are adjacent to each other, and the currents in the adjacent lines flow in the opposite directions from each other. One line of the resonance line 211*a* and one line of the resonance line 211*b* are adjacent to each other, and the currents in the two adjacent lines also flow in the opposite directions from each other. Accordingly, the currents in each two adjacent lines flow in the opposite directions from each other in a resonant state.

Figure 5:
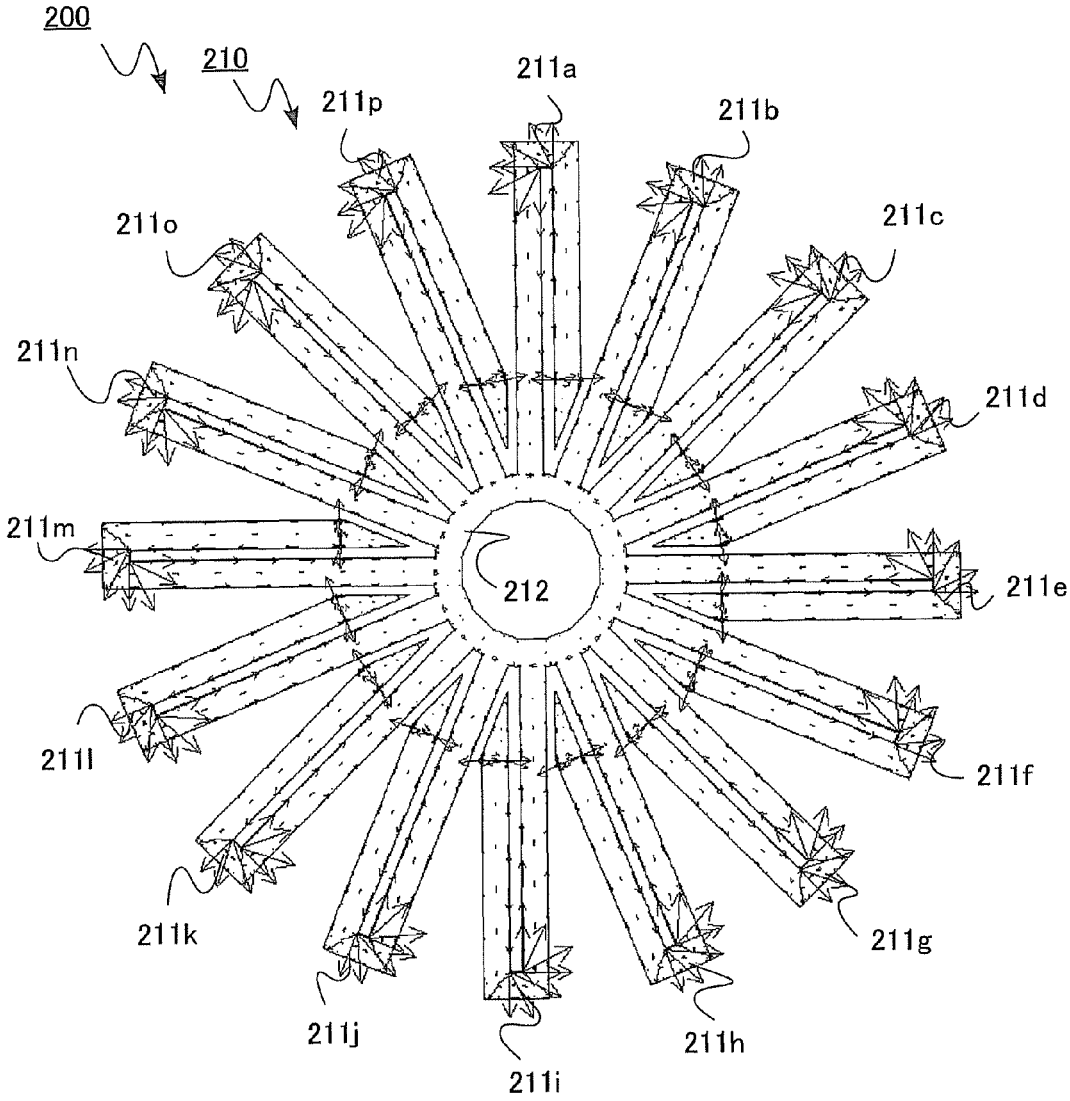
FIG. 5 shows the results of an electromagnetic simulation performed to check the current distribution in a resonant state of the resonator of the second embodiment.

FIG. 5 shows the results of an electromagnetic field simulation performed to check the current distribution in a resonant state of the resonator of this embodiment. In FIG. 5, the length of the arrows represents the magnitude of currents, and the orientations of the arrows represent the directions of the currents. Current standing waves that use the center portions of the respective resonance lines as antinodes and use both ends of each resonance line as nodes are generated in the resonance lines 211*a* through 211*p*. Currents flowing in the opposite directions from each other in a resonant state are generated in each two adjacent lines of the resonance lines.

Next, the results of evaluations made on the power handling capability and the Q value of the resonator 200 having the structure illustrated in FIG. 4 are described. In the resonator 200, the resonance frequency is 5350 GHz, the line width of each of the resonance lines is 0.5 mm, the line width of the connection line is 0.5 mm, and the lengths of all the resonance lines are the same.

The resonator 200 is formed by patterning the YBCO superconductive thin film on the sapphire substrate. After the resonator 200 is cooled by a refrigerator, the power handling capability and the Q value are evaluated in the same manner as in the first embodiment. The results show that the power handling capability is 7.5 W, and the Q value is 30000. A Q value derived from radiation loss is calculated through an electromagnetic field simulation, to obtain the value of 82000.

As described above, in the resonator 200 of this embodiment, the currents flowing in the resonator are distributed to the resonance lines, so as to achieve high power handling capability as in the first embodiment. The radiation loss is also reduced by the currents flowing in the opposite directions from each other in each two adjacent lines. In this manner, the high Q value, which is inherent to a low-loss material, is achieved. Thus, it becomes possible to achieve both high power handling capability and a high Q value. Furthermore, unlike the resonator of the first embodiment, the resonator of this embodiment has only one line structure, and does not have two line structures connected to function as one resonator. Accordingly, the resonator of this embodiment has fewer unnecessary resonance modes, and has excellent spurious characteristics.

Third Embodiment

A resonator of a third embodiment of the present invention is a resonator of a microstripline structure, and has a line structure that is formed with resonance lines having current standing waves generated in the lines in a resonant state and having currents flowing in the opposite directions from each other in each two adjacent lines, and connection lines that connect the resonance lines at the portions having in-phase, voltages among the nodes of the current standing waves of the resonance lines in a resonant state. This resonator is basically the same as the resonator of the first embodiment, except that the electrical length of each of the resonance lines is 360 degrees, which is twice as large as 180 degrees, in resonance frequency. The microstripline structure and the actions and effects of the resonator are the same as those of the first embodiment, and therefore, explanation of them is omitted herein.

Figure 6:
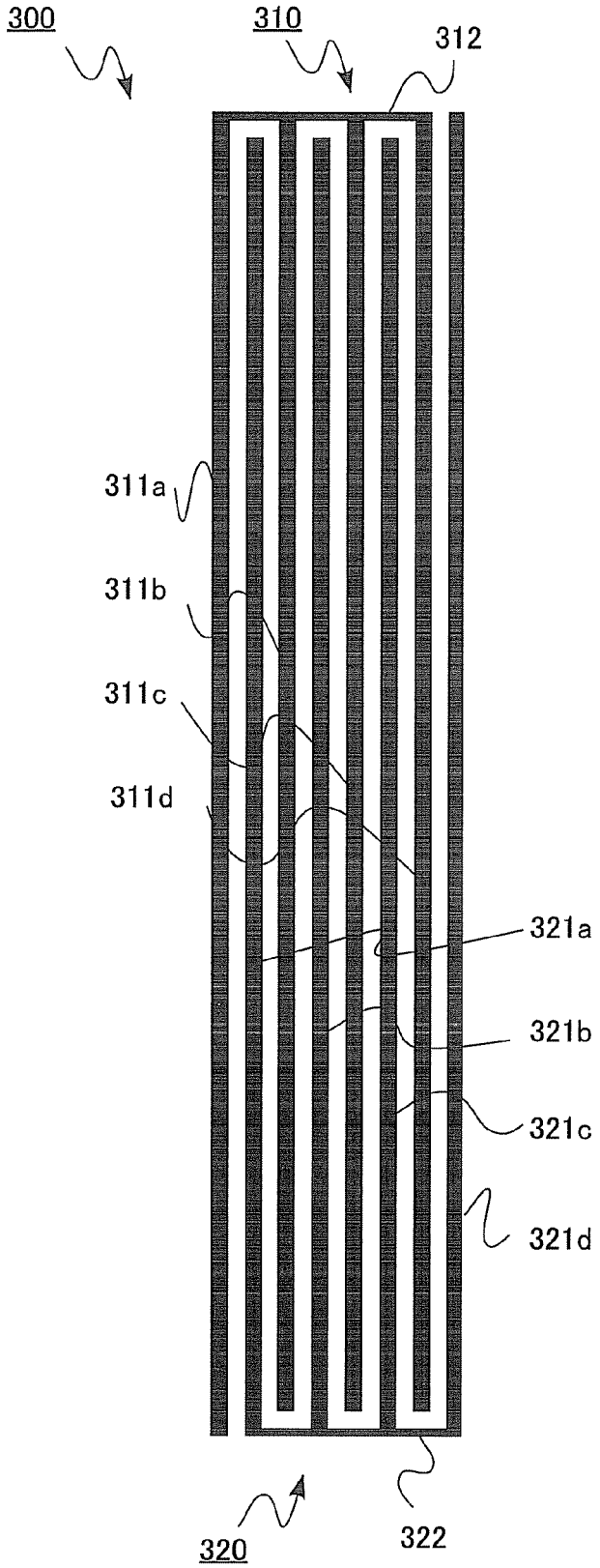
FIG. 6 is a plan view of the stripline pattern of a resonator of a third embodiment.

FIG. 6 is a plan view of the stripline pattern of the resonator of this embodiment. As shown in FIG. 6, the resonator 300 has two comb-like line structures 310 and 320.

The line structure 310 includes four linear resonance lines 311*a* through 311*d*. The resonance lines 311*a* through 311*d* each have an electrical length of 360 degrees in resonance frequency, and have substantially the same shapes. Having substantially the same shapes means that the line lengths, the line widths, and the shapes of the top end portions might slightly differ from one another. In this embodiment, the resonance line 311*a* at the outermost side has a greater length than the other resonance lines. With this arrangement, the radiation loss can be reduced approximately 10%. One end of each of the resonance lines 311*a* through 311*d* is connected to the others by a connection line 312.

The connected end portions of the resonance lines 311*a* through 311*d* are open to the ground, and therefore, serve as the nodes of current standing waves in a resonant state. Accordingly, the voltages at the portions are in phase.

The line structure 320 is also formed with four linear resonance lines 321*a* through 321*d*, and a connection line 322. In the line structure 320, the same current standing waves as those generated in the line structure 310 are generated in a resonant state.

The line structure 310 and the line structure 320 are combined so that the resonance lines 311*a* through 311*d* of the line structure 310 and the resonance lines 321*a* through 321*d* of the line structure 320 are alternately located. More specifically, the line structure 310 and the line structure 320 are combined in a nested fashion, so that the comb-shaped portions face each other. When current standing waves are generated in the lines in a resonant state in the resonator 300, there are a reverse-direction resonance mode in which the current in the resonance line 311*a* flows in the opposite direction from the flowing direction of the current in the resonance line 321*a*, and a forward-direction resonance mode in which the currents flow in the same direction. In this embodiment, the reverse-direction resonance mode is used.

Figure 7:
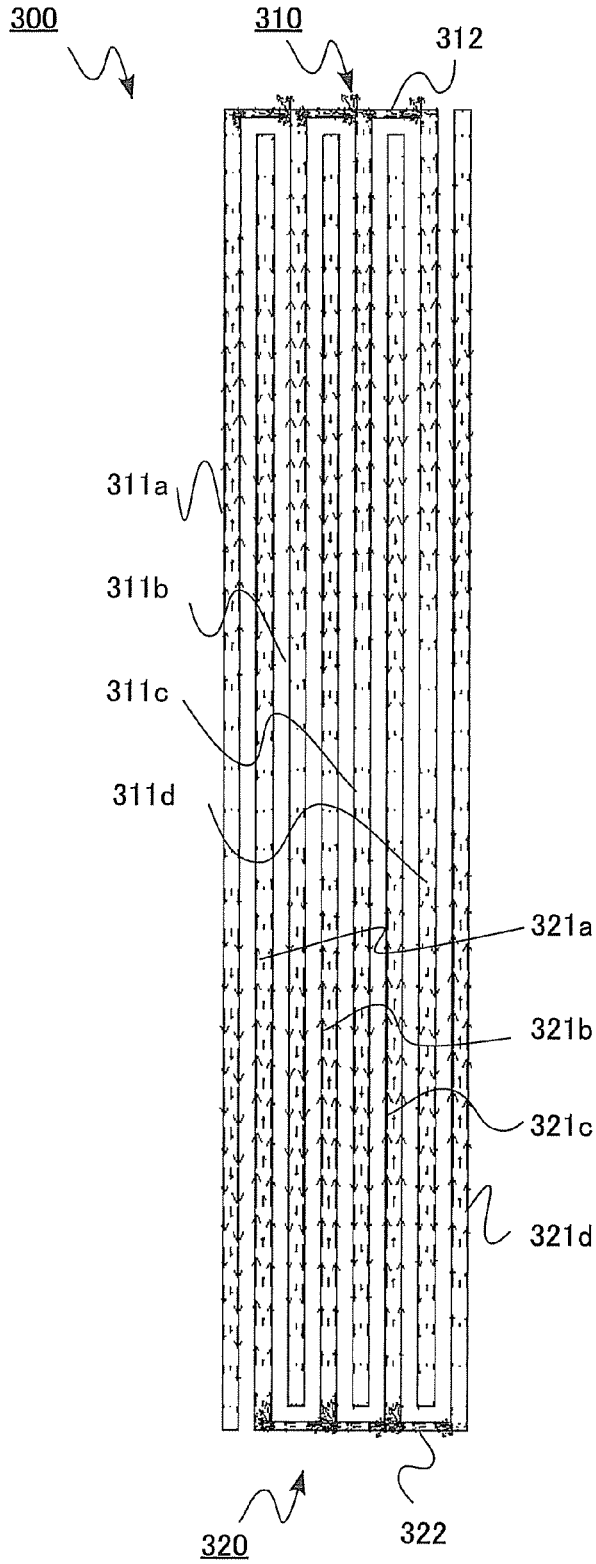
FIG. 7 shows the results of an electromagnetic simulation performed to check the current distribution in a resonant state of the resonator of the third embodiment.

FIG. 7 shows the results of an electromagnetic field simulation performed to check the current distribution in a resonant state in the resonator of this embodiment. Current standing waves that use the center portions and the end portions of the respective resonance lines as nodes, and each have two antinodes are generated in the resonance lines 311*a* through 311*d* and 321*a* through 321*d*. Currents flowing in the opposite directions from each other are generated in each two adjacent lines of the resonance lines: 311*a* and 321*a*, 321*a* and 311*b*, 311*b* and 321*b*, 321*b* and 311*c*, 311*c* and 321*c*, 321*c* and 311*d*, and 311*d* and 321*d*.

Next, the results of evaluations made on the power handling capability and the Q value of the resonator 300 having the structure illustrated in FIG. 6 are described. In the resonator 300, the resonance frequency is 5350 GHz, the line width of each of the resonance lines is 0.3 mm, the line width of each of both connection lines is 0.15 mm, the distance between each two adjacent resonance lines is 0.3 mm, and the lengths of the resonance lines are the same, except that the outermost resonance lines are slightly longer.

The resonator 300 is formed by patterning the YBCO superconductive thin film on the sapphire substrate. After the resonator 300 is cooled by a refrigerator, the power handling capability and the Q value are evaluated in the same manner as in the first embodiment. The results show that the power handling capability is 25 W, and the Q value is 38000. A Q value derived from radiation loss is calculated through an electromagnetic field simulation, to obtain the value of 106000. Compared with the first embodiment, the lengths of the resonance lines are twice as large, and accordingly, the power handling capability is about twice as high. This proves that the power handling capability can be effectively improved by elongating the length of each resonance line to twice, three times, four times, . . . as large as 180 degrees in electrical length.

As described above, in the resonator 300 of this embodiment, the currents flowing in the resonator are distributed to the resonance lines, so as to achieve high power handling capability as in the first embodiment. The radiation loss is also reduced by the currents flowing in the opposite directions from each other in each two adjacent lines. In this manner, the high Q value, which is inherent to a low-loss material, is achieved. Thus, it becomes possible to achieve both high power handling capability and a high Q value. Furthermore, the power handling capability is made higher by doubling the length of each resonance line, compared with the length of each resonance line of the first embodiment. In this embodiment, the electrical length of each resonance line is 360 degrees, which is twice as large as 180 degrees. However, the electrical length of each resonance length of this embodiment may be further increased to three times, four times, . . . as large as 180 degrees.

Modification of Third Embodiment

A resonator of this modification is the same as the resonator of the third embodiment, except that the end portion of each resonance line not connected to the connection line is T-shaped. Explanation of the same aspects as those of the third embodiment is omitted herein.

Figure 8:
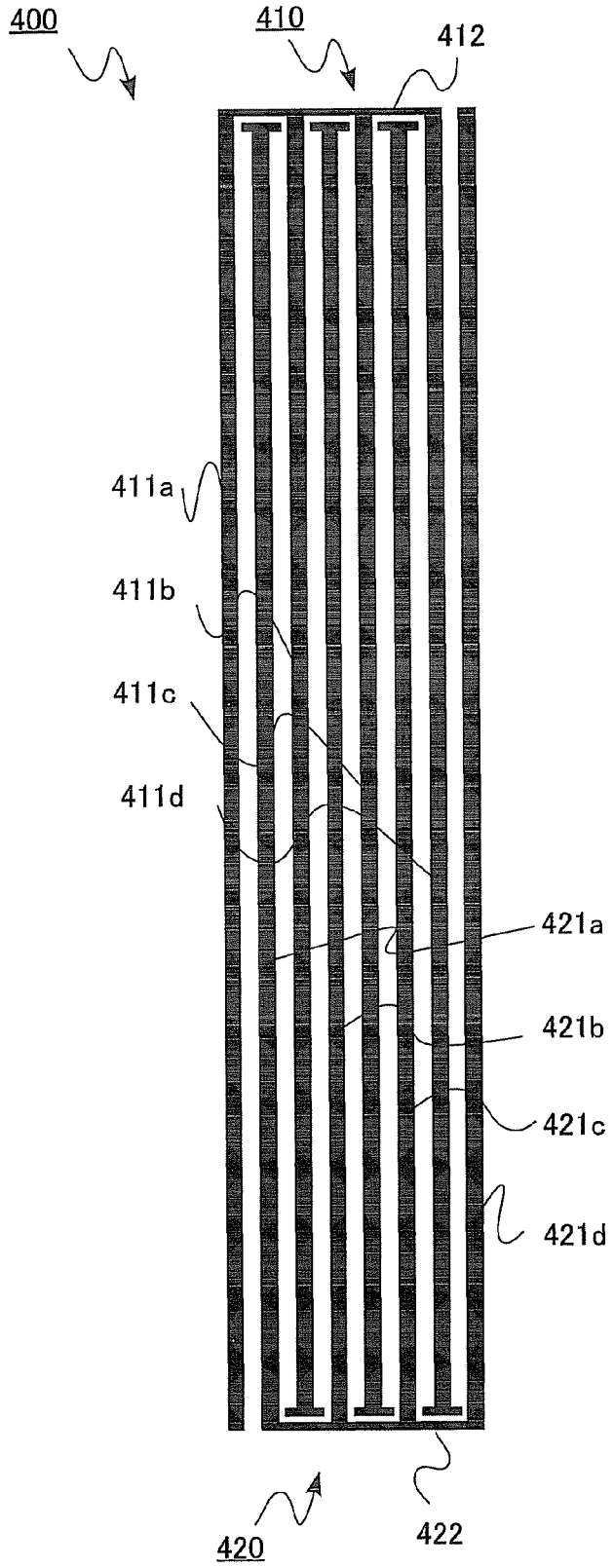
FIG. 8 is a plan view of the stripline pattern of a resonator as a modification of the third embodiment.

FIG. 8 is a plan view of the stripline pattern of the resonator of this modification. As shown in FIG. 8, the resonator 400 has two comb-like line structures 410 and 420.

The line structure 410 includes four linear resonance lines 411*a* through 411*d*. The resonance lines 411*a* through 411*d* each have an electrical length of 360 degrees in resonance frequency, and have substantially the same shapes. In this modification, the resonance line 411*a* at the outermost side has a greater length than the other resonance lines. One end of each of the resonance lines 411*a* through 411*d* is connected to the others by a connection line 412. The three resonance lines 411*b* through 411*d* each have a T-shaped end portion not connected to the connection line of the resonance line. With the T-shaped end portions, the radiation loss can be reduced by 10% to 200%. The line structure 420 is also formed with four linear resonance lines 421*a* through 421*d*, and a connection line 422.

Figure 9:
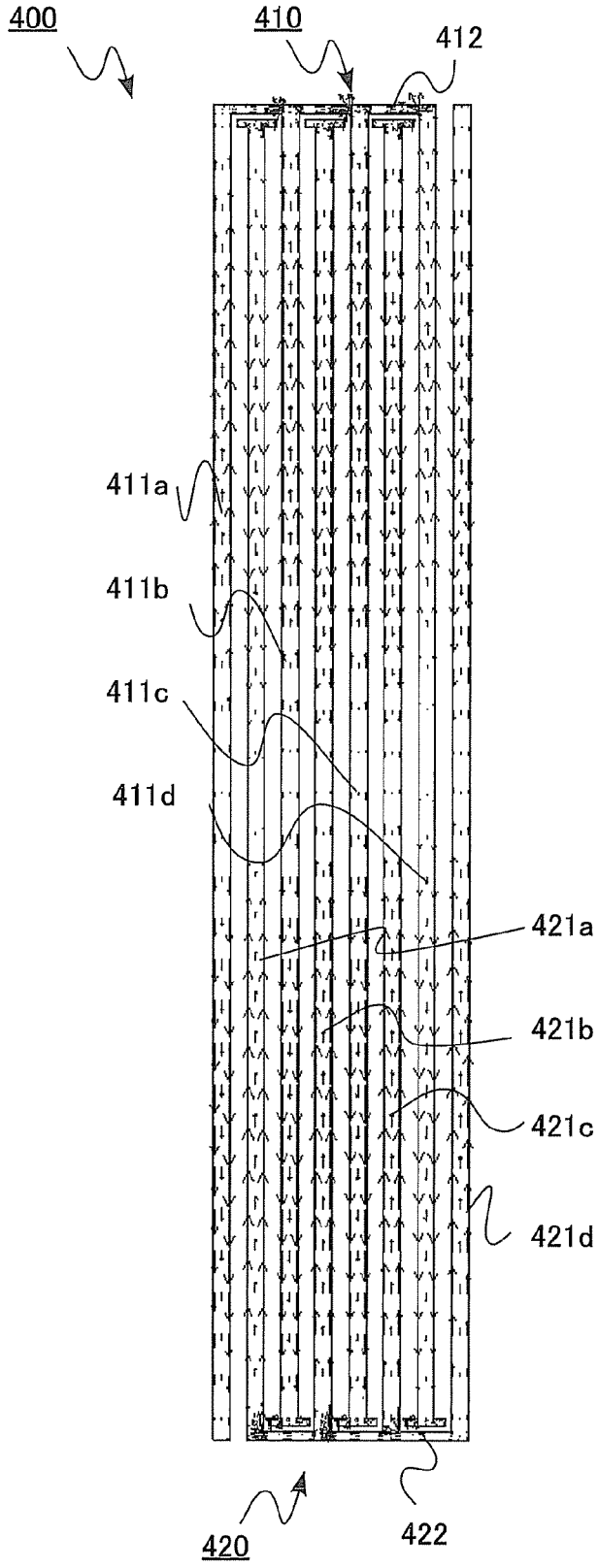
FIG. 9 shows the results of an electromagnetic simulation performed to check the current distribution in a resonant state of the resonator as a modification of the third embodiment.

FIG. 9 shows the results of an electromagnetic field simulation performed to check the current distribution in a resonant state in the resonator of this modification. Current standing waves that use the center portions and the end portions of the respective resonance lines as nodes, and each have two antinodes are generated in the resonance lines 411*a* through 411*d* and 421*a* through 421*d*. Currents flowing in the opposite directions from each other are generated in each two adjacent lines of the resonance lines.

As described above, in the resonator 400 of this modification, the currents flowing in the resonator are distributed to the resonance lines, so as to achieve high power handling capability as in the third embodiment. The radiation loss is also reduced by the currents flowing in the opposite directions from each other in each two adjacent lines. In this manner, the high Q value, which is inherent to a low-loss material, is achieved. Thus, it becomes possible to achieve both high power handling capability and a high Q value. Furthermore, the radiation loss can be made smaller than the radiation loss in the third embodiment by forming the end portions of the resonance lines into T-shaped portions.

Fourth Embodiment

A resonator of a fourth embodiment of the present invention is a resonator of a microstripline structure, and is the same as the resonator of any of the first through third embodiments in including a line structure that is formed with resonance lines having current standing waves generated in the lines in a resonant state and having currents flowing in the opposite directions from each other in each two adjacent lines, and connection lines that connect the resonance lines at the portions having in-phase voltages among the nodes of the current standing waves of the resonance lines in a resonant state. The microstripline structure and the actions and effects of the resonator are the same as those of the first through third embodiments, and therefore, explanation of them is omitted herein.

This resonator includes line structures each having resonance lines that each have an electrical length approximately integral-number times as large as 180 degrees in resonance frequency and have substantially the same shapes, and connection lines that connect the resonance lines to one another at the portions that are geometrically equivalent to one another and each have an electrical length approximately integral-number times as large as 180 degrees from the end portion of the resonance line in resonance frequency. Each of the line structures includes three or more resonance lines, and at least one of the resonance lines of one of the line structures is placed along at least one of the resonance lines of another one of the line structures.

This resonator is formed with three or more line structures of substantially the same shape. Each of the line structures is formed with a first comb-like unit having some of linear resonance lines connected at their end portions by a connection line so that the lines lie substantially parallel to one another, and a second comb-like unit having the remaining ones of the resonance lines connected by the connection line at their end portion so that the lines lie substantially parallel to one another. The connection line has a bent portion between the first comb-like unit and the second comb-like unit. The line structures are combined so that a comb-like unit of one of the line structures faces a comb-like unit of another one of the line structures. In this manner, some resonance lines of one of the line structures and some resonance lines of another one of the line structures are alternately located.

Figure 10:
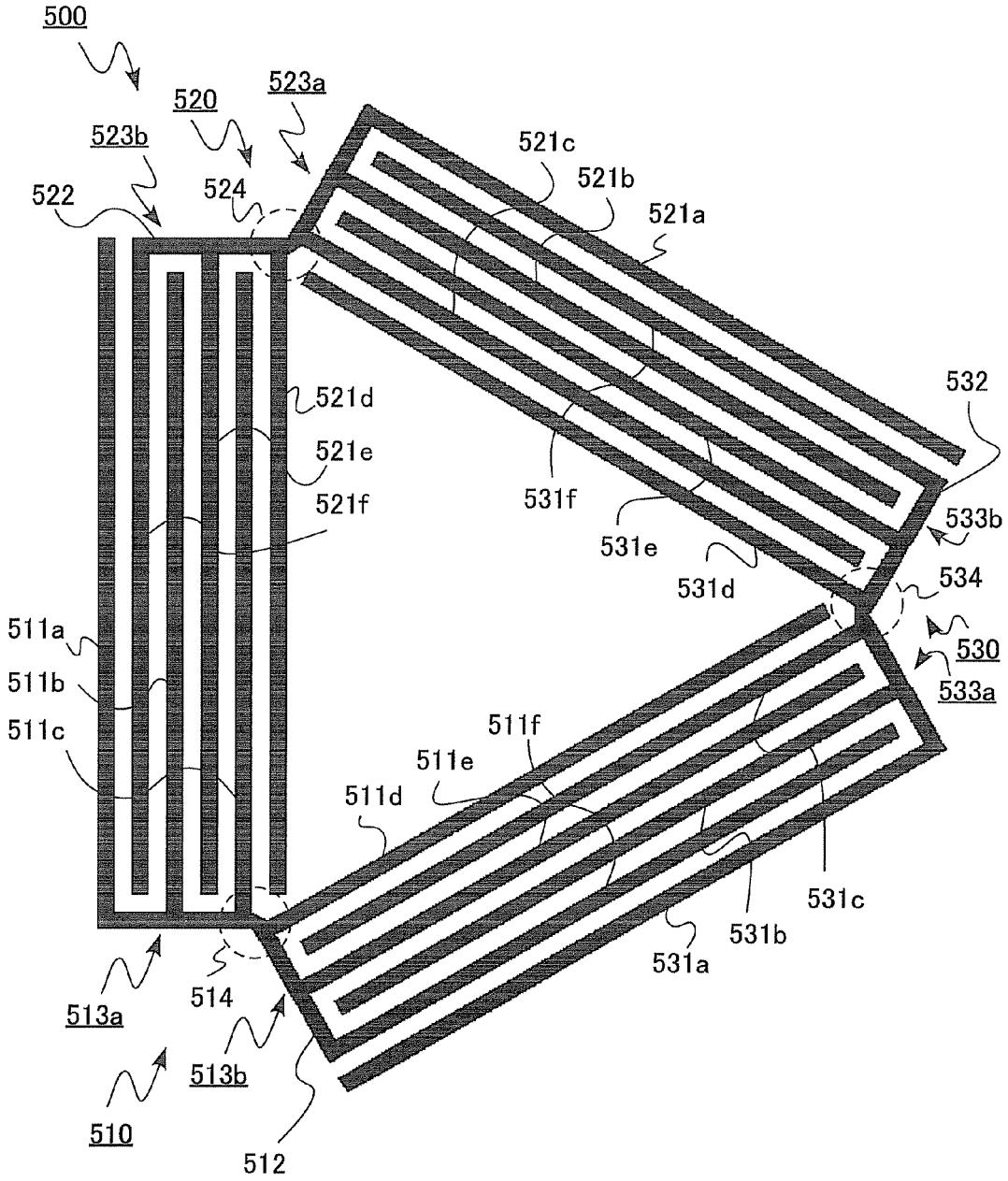
FIG. 10 is a plan view of the stripline pattern of a resonator of a fourth embodiment.

FIG. 10 is a plan view of the stripline pattern of the resonator of this embodiment. As shown in FIG. 10, the resonator 500 has three line structures 510, 520, and 530 of substantially the same shape. The line structure 510 is formed with a first comb-like unit 513a having three lines 511*a* through 511*c* of six linear resonance lines 511*a* through 511*f* connected at their end portions by a connection line 512 so that the three lines 511*a* through 511*c* lie substantially parallel to one another, and a second comb-like unit 513*b* having the remaining three lines 511*d* through 511*f* of the six resonance lines connected at their end portions by the connection line 512 so that the three lines 511*d* through 511*f* lie substantially parallel to one another. The connection line 512 has a bent portion 514 between the first comb-like unit 513*a* and the second comb-like unit 513*b*. The electrical length of each of the resonance lines is approximately 180 degrees in resonance frequency.

Likewise, the line structure 520 is formed with a first comb-like unit 523*a* having three lines 521*a* through 521*c* of six linear resonance lines 521*a* through 521*f* connected at their end portions by a connection line 522 so that the three lines 521*a* through 521*c* lie substantially parallel to one another, and a second comb-like unit 523*b* having the remaining three lines 521*d* through 521*f* of the six resonance lines connected at their end portions by the connection line 522 so that the three lines 521*d* through 521*f* lie substantially parallel to one another. The connection line 522 has a bent portion 524 between the first comb-like unit 523*a* and the second comb-like unit 523*b*.

Likewise, the line structure 530 is formed with a first comb-like unit 533*a* having three lines 531*a* through 531*c* of six linear resonance lines 531*a* through 531*f* connected at their end portions by a connection line 532 so that the three lines

531*a* through 531*c* lie substantially parallel to one another, and a second comb-like unit 533*b* having the remaining three lines 531*d* through 531*f* of the six resonance lines connected at their end portions by the connection line 532 so that the three lines 531*d* through 531*f* lie substantially parallel to one another. The connection line 532 has a bent portion 534 between the first comb-like unit 533*a* and the second comb-like unit 533*b*.

The line structures are combined so that a comb-like unit of one of the line structures faces a comb-like unit of another one of the line structures. In this manner, some resonance lines of one of the three line structures 510, 520, and 530 and some resonance lines of another one of the line structures are alternately located. For example, in FIG. 10, the line structures 510, 520, and 530 are combined so that the first comb-like unit 513*a* of the line structure 510 faces the second comb-like unit 523*b* of the line structure 520. In this manner, the resonance lines 511*a* through 511*c* of the line structure 510 and the resonance lines 521*d* through 521*f* of the line structure 520 are alternately located.

In the resonator 500 of this embodiment, the three line structures 510, 520, and 530 are electromagnetically connected so as to function as one resonator.

Figure 11:
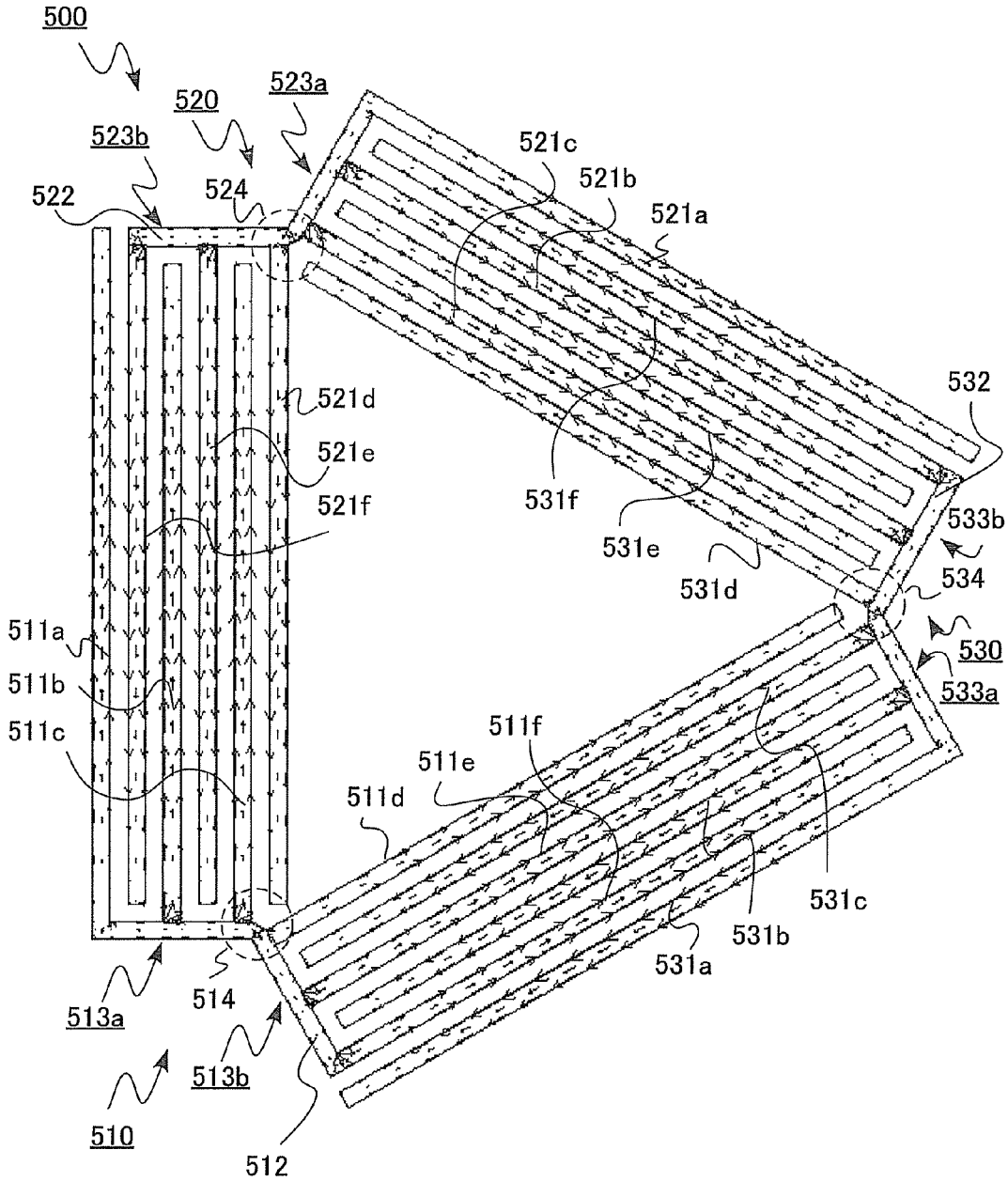
FIG. 11 shows the results of an electromagnetic simulation performed to check the current distribution in a resonant state of the resonator of the fourth embodiment.

FIG. 11 shows the results of an electromagnetic field simulation performed to check the current distribution in a resonant state in the resonator of this embodiment. In FIG. 11, the lengths of the arrows represent the magnitude of currents, and the orientations of the arrows represent the directions of the currents. Current standing waves that use the center portions of the respective resonance lines as antinodes and use both end portions as nodes are generated in the resonance lines 511*a* through 511*f*, 521*a* through 521*f*, and 531*a* through 531*f*. Currents flowing in the opposite directions from each other in a resonant state are generated in each two adjacent lines.

Next, the results of evaluations made on the power handling capability and the Q value of the resonator 500 having the structure illustrated in FIG. 10 are described. In the resonator 500, the resonance frequency is 5350 GHz, the line width of each of the resonance lines is 0.3 mm, the line width of each of both connection lines is 0.3 mm, the distance between each two adjacent resonance lines is 0.3 mm, and the lengths of the resonance lines are the same, except that the outermost resonance lines are slightly longer.

The resonator 500 is formed by patterning the YBCO superconductive thin film on the sapphire substrate. After the resonator 500 is cooled by a refrigerator, the power handling capability and the Q value are evaluated in the same manner as in the first embodiment. The results show that the power handling capability is 24 W, and the Q value is 45000. A Q value derived from radiation loss is calculated through an electromagnetic field simulation, to obtain the value of 94000.

As described above, in the resonator 500 of this embodiment, the currents flowing in the resonator are distributed to the resonance lines, so as to achieve high power handling capability, as in the first through third embodiments. The radiation loss is also reduced by the currents flowing in the opposite directions from each other in each two adjacent lines. In this manner, the high Q value, which is inherent to a low-loss material, is achieved. Thus, it becomes possible to achieve both high power handling capability and a high Q value.

Fifth Embodiment

A resonator of a fifth embodiment of the present invention is the same as the resonator of the fourth embodiment, except that the resonator of this embodiment has four line structures. Therefore, explanation of the same aspects as those of the fourth embodiment is omitted herein.

Figure 12:
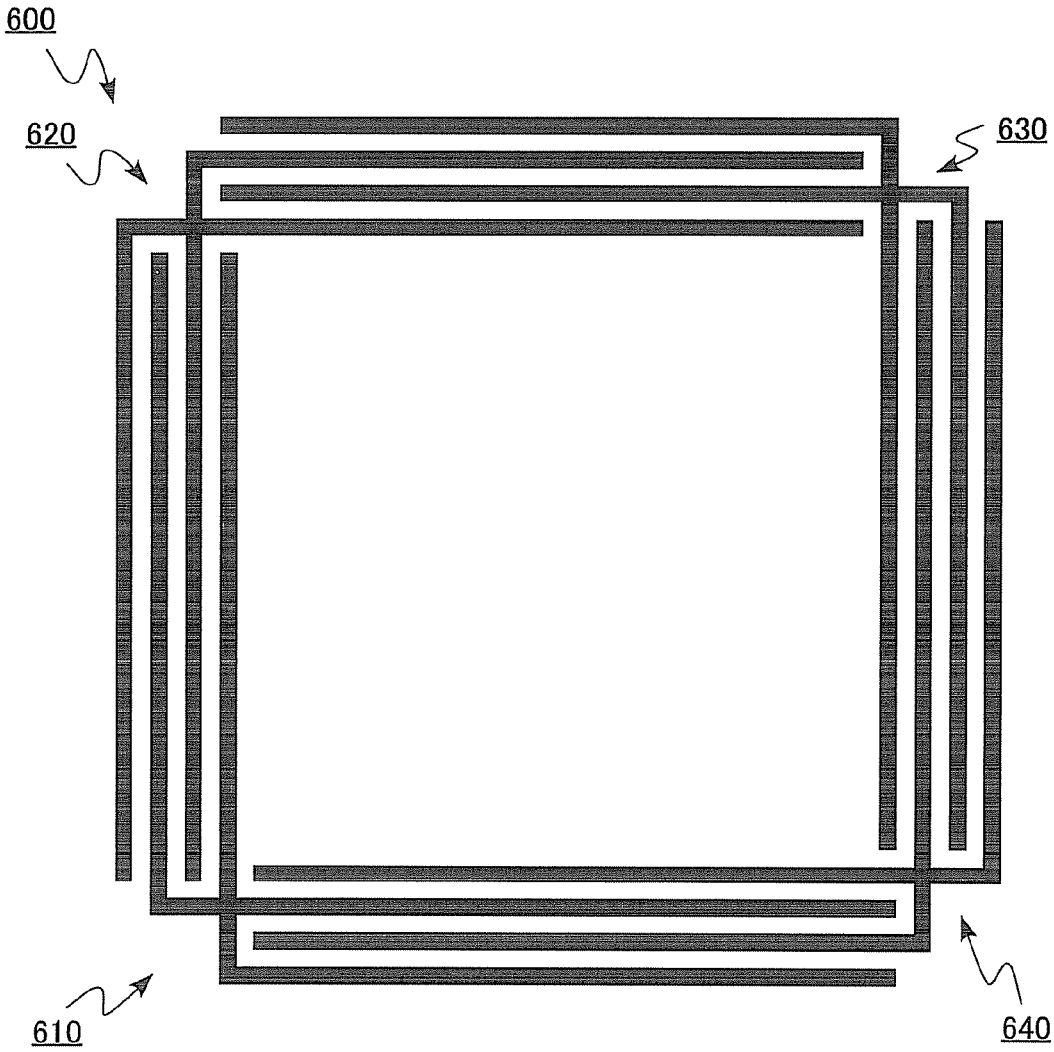
FIG. 12 is a plan view of the stripline pattern of a resonator of a fifth embodiment.

FIG. 12 is a plan view of the stripline pattern of the resonator of this embodiment. As shown in FIG. 12, the resonator 600 has four line structures 610, 620, 630, and 640 of substantially the same shape. Each of the line structures is formed with a first comb-like unit having two lines of four linear resonance lines connected at their end portions by a connection line so that the two lines lie substantially parallel to each another, and a second comb-like unit having the remaining two lines of the four resonance lines connected at their end portions by the connection line so that the two lines lie substantially parallel to each another. The connection line has a bent portion between the first comb-like unit and the second comb-like unit. The electrical length of each of the resonance lines is approximately 180 degrees in resonance frequency.

The four line structures 610, 620, 630, and 640 are combined so that a comb-like unit of one of the line structures faces a comb-like unit of another one of the line structures. In this manner, the resonance lines of any one of the four line structures and the resonance lines of another one of the four line structures are alternately located.

Figure 13:
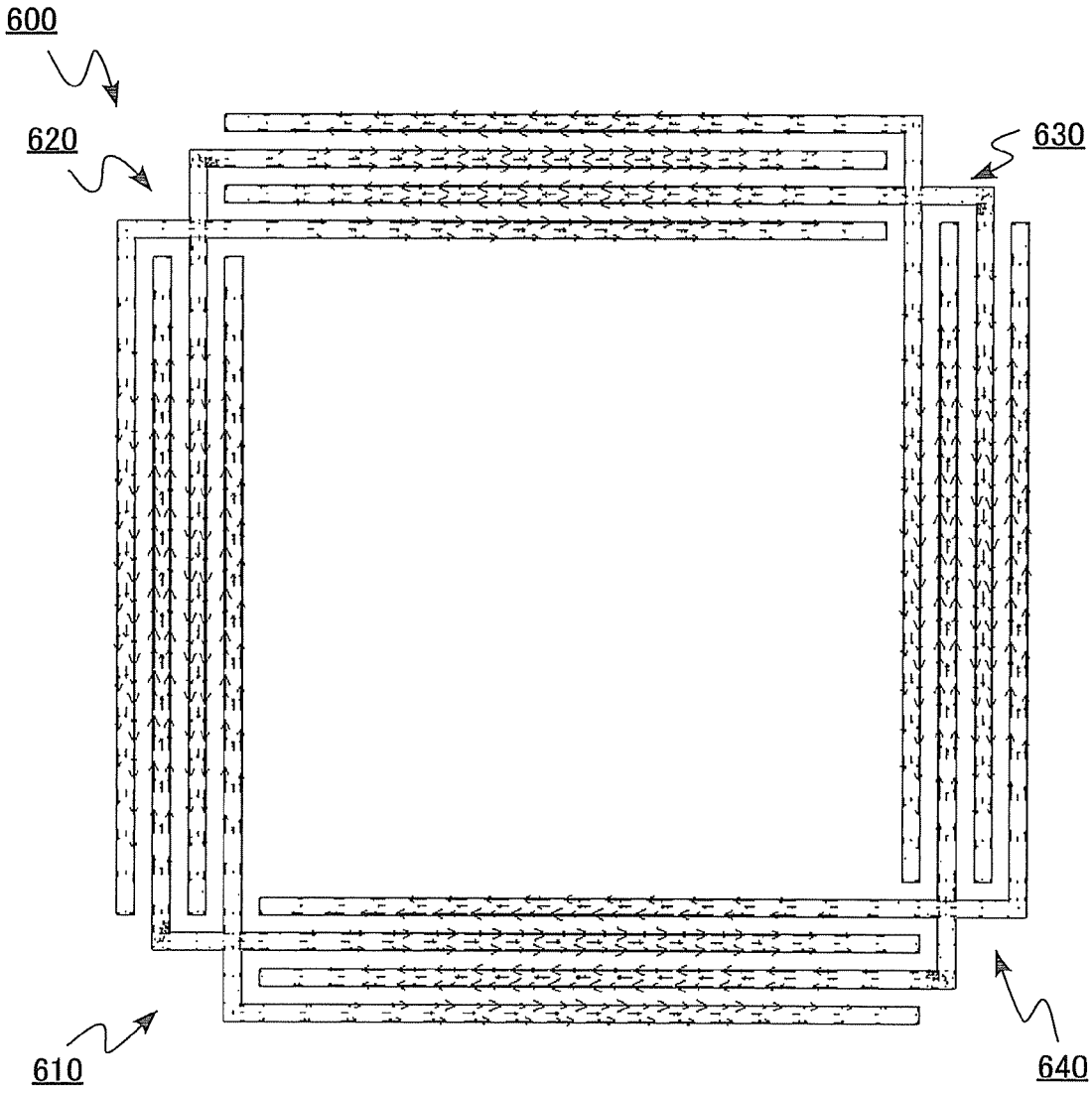
FIG. 13 shows the results of an electromagnetic simulation performed to check the current distribution in a resonant state of the resonator of the fifth embodiment.

FIG. 13 shows the results of an electromagnetic field simulation performed to check the current distribution in a resonant state in the resonator of this embodiment. In FIG. 13, the lengths of the arrows represent the magnitude of currents, and the orientations of the arrows represent the directions of the currents. Current standing waves that use the center portions of the respective resonance lines as antinodes and use both end portions as nodes are generated in the resonance lines. Currents flowing in the opposite directions from each other in a resonant state are generated in each two adjacent lines.

As described above, in the resonator 600 of this embodiment, the currents flowing in the resonator are distributed to the resonance lines, so as to achieve high power handling capability, as in the first through fourth embodiments. The radiation loss is also reduced by the currents flowing in the opposite directions from each other in each two adjacent lines. In this manner, the high Q value, which is inherent to a low-loss material, is achieved. Thus, it becomes possible to achieve both high power handling capability and a high Q value.

Sixth Embodiment

A resonator of a sixth embodiment of the present invention is a resonator of a microstripline structure, and is the same as the resonator of any of the first through fifth embodiments in including a line structure that is formed with resonance lines having current standing waves generated in the lines in a resonant state and having currents flowing in the opposite directions from each other in each two adjacent lines, and connection lines that connect the resonance lines at the portions having in-phase voltages among the nodes of the current standing waves of the resonance lines in a resonant state. The microstripline structure and the actions and effects of the resonator are the same as those of the first through fifth embodiments, and therefore, explanation of them is omitted herein.

This resonator of this embodiment includes first and second line structures of different shapes from each other. The first line structure is formed with linear resonance lines that have an electrical length of 360 degrees or greater in resonance frequency and are located substantially parallel to one another, and a connection line that connects the resonance lines to one another at the portions that are geometrically equivalent to one another and each have an electrical length substantially integral-number times as large as 180 degrees from either end portion of the resonance line in resonance frequency.

The second line structure is formed with linear resonance lines and a connection line. Each of the linear resonance lines is located in a substantially parallel fashion between each corresponding two adjacent resonance lines of the first line structure, and has an electrical length substantially integral-number times as large as 180 degrees in resonance frequency. The connection line connects the end portions of the linear resonance lines each having the electrical length substantially integral-number times as large as 180 degrees in resonance frequency, and surrounds the first line structure.

Figure 14:
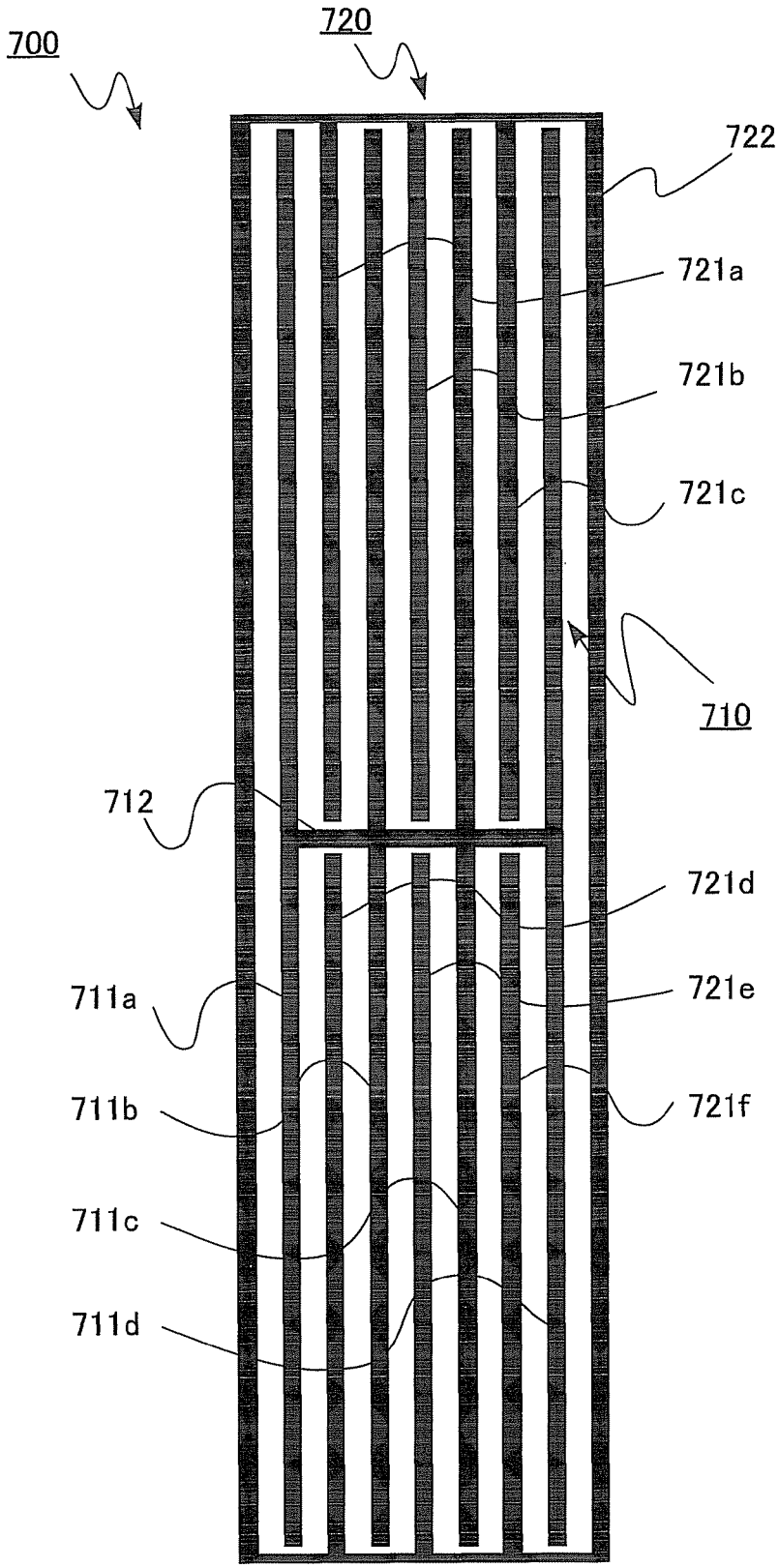
FIG. 14 is a plan view of the stripline pattern of a resonator of a sixth embodiment.

FIG. 14 is a plan view of the stripline pattern of the resonator of this embodiment. As shown in FIG. 14, the resonator 700 has first and second line structures 710 and 720 of different shapes from each other. The two line structures 710 and 720 are electromagnetically connected so as to function as one resonator.

The first line structure 710 includes linear resonance lines 711*a* through 711*d* that have an electrical length of approximately 360 degrees, which is twice as large as 180 degrees in resonance frequency, and are located substantially parallel to one another. The first line structure 710 also includes a connection line 712 that connects the resonance lines 711*a* through 711*d* at the portions that are geometrically equivalent to one another and each have an electrical length of 180 degrees in resonance frequency from either end of each corresponding one of the resonance lines 711*a* through 711*d*, or at the midpoints of the resonance lines 711*a* through 711*d*.

The second line structure 720 is formed with linear resonance lines 721*a* through 721*f* and a connection line 722. Each of the linear resonance lines 721*a* through 721*f* is located in a substantially parallel fashion between each corresponding two adjacent resonance lines of the resonance lines 711*a* through 711*d* of the first line structure 710, and has an electrical length of approximately 180 degrees in resonance frequency. The connection line 722 connects the end portions of the resonance lines 721*a* through 721*f* and surrounds the first line structure 710.

Figure 15:
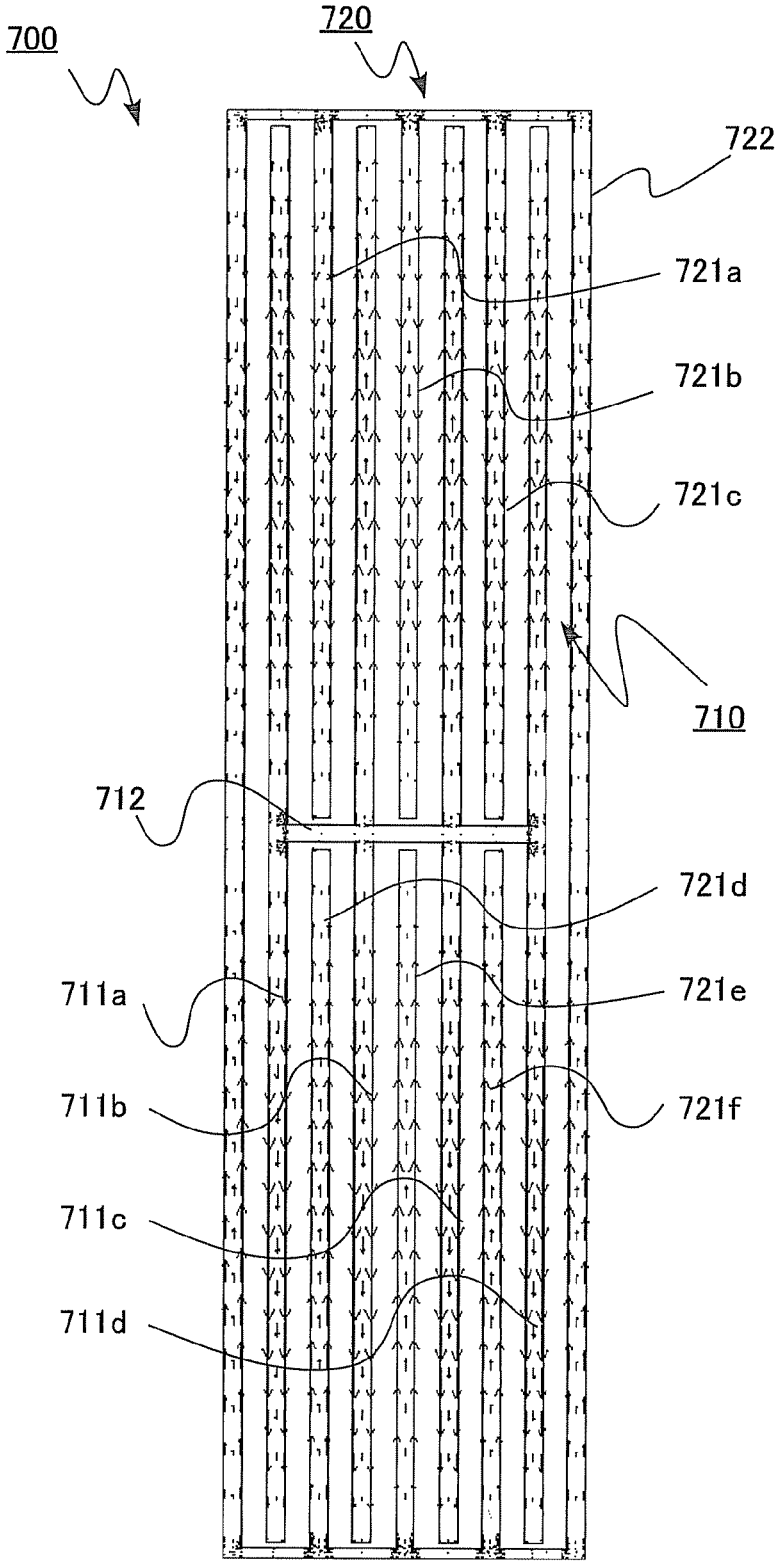
FIG. 15 shows the results of an electromagnetic simulation performed to check the current distribution in a resonant state of the resonator of the sixth embodiment.

FIG. 15 shows the results of an electromagnetic field simulation performed to check the current distribution in a resonant state in the resonator of this embodiment. In FIG. 15, the lengths of the arrows represent the magnitude of currents, and the orientations of the arrows represent the directions of the currents. Current standing waves that use the portions connected to the connection line 712 and both end portions as the nodes and use the connected portions and the midpoints between both end portions as the antinodes are generated in the resonance lines 711*a* through 711*d* of the first line structure 710. Current standing waves that use the midpoints of the respective resonance lines as the antinodes and use both end portions as the nodes are generated in the resonance lines 721*a* through 721*f* of the second line structure 720. Currents flowing in the opposite directions from each other in a resonant state are generated in each two adjacent lines.

Next, the results of evaluations made on the power handling capability and the Q value of the resonator 700 having the structure illustrated in FIG. 14 are described. In the resonator 700, the resonance frequency is 5350 GHz, the line width of each of the resonance lines is 0.3 mm, the line width of each of the connection lines is 0.3 mm (partially 0.15 mm), and the distance between each two adjacent resonance lines is 0.4 mm.

The resonator 700 is formed by patterning the YBCO superconductive thin film on the sapphire substrate. After the resonator 700 is cooled by a refrigerator, the power handling capability and the Q value are evaluated in the same manner as in the first embodiment. The results show that the power handling capability is 26 W, and the Q value is 55000. A Q value derived from radiation loss is calculated through an electromagnetic field simulation, to obtain the value of 920000. As this resonator has much smaller radiation loss than the radiation loss in any of the other embodiments, this resonator can exhibit the most low-loss characteristics of the material.

As described above, in the resonator 700 of this embodiment, the currents flowing in the resonator are distributed to the resonance lines, so as to achieve high power handling capability, as in the first through fifth embodiments, while maintaining high power handling capability. The radiation loss is also reduced by the currents flowing in the opposite directions from each other in each two adjacent lines. In this manner, the high Q value, which is inherent to a low-loss material, is achieved. Thus, it becomes possible to achieve both high power handling capability and a high Q value.

Seventh Embodiment

A filter of a seventh embodiment of the present invention is a filter formed with one or more resonators of one of the first through sixth embodiments, for example.

Figure 16:
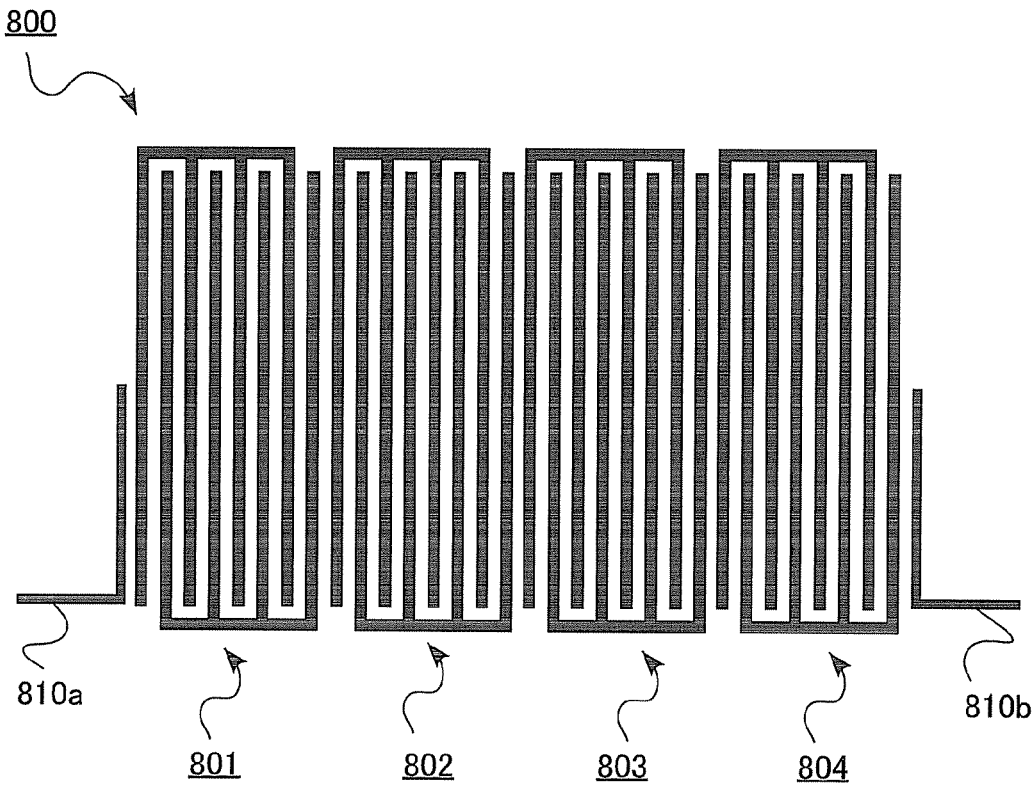
FIG. 16 is a plan view showing the conductor line pattern of a filter of a seventh embodiment.

FIG. 16 is a plan view of the conductor line pattern of the filter of this embodiment. The filter 800 is a four-stage Chebyshev filter in which four resonators 801, 802, 803, and 804 each having the same shape as the resonator 100 of the first embodiment illustrated in FIG. 1 are arranged in series. L-shaped conductor lines are placed near the resonators, and are elongated to the end portions of the substrate, so as to serve as input/output feeders 810*a* and 810*b*.

With the use of resonators having low loss and high power handling capability, a filter having low loss and high power handling capability can be realized in the above manner. Although a four-stage Chebyshev filter has been described as an example, the present invention is not limited to that. Rather, the present invention can be applied to filters of various types such as bandpass filters, band-stop filters, high-pass filters, and low-pass filters that are formed with one or more resonators.

The embodiments of the present invention have been described so far, with reference to specific examples. In the above description of the embodiments, the portions that are not essential in explanation of resonators or filters of the present invention have not been described. However, any elements related to resonator and filters may be selectively used, if necessary.

In addition to the foregoing, all resonators and filters provided with the elements of the present invention and designed or modified by those skilled in the art as appropriate are within the scope of the present invention. In other words, additional advantages and modifications will readily occur to those skilled in the art.

What is claimed is:

1. A resonator having a microstripline structure, comprising a plurality of line structures each including: a plurality of resonance lines of substantially the same shape having an electrical length approximately integral-number times as large as 180 degrees in resonance frequency; and a connection line that connects the resonance lines to one another at portions that are geometrically equivalent to one another and each portions have an electrical length approximately integral-number times as large as 180 degrees in resonance frequency from an end portion of the each resonance lines, wherein each of the line structures including three or more of the resonance lines, at least one of the resonance lines of one of the line structures being placed along at least one of the resonance lines of another one of the line structures.

2. The resonator according to claim 1, wherein the resonator consists of two line structures;

each of the line structures has substantially the same comb-like shape having end portions of the resonance lines connected by the connection line, the resonance lines each having a linear shape, the connection line having a linear shape; and the line structures are combined in such a manner that the comb-like shapes face each other, and the resonance lines of one of the line structures and the resonance lines of the other one of the line structures are alternately located.

3. The resonator according to claim 1, wherein the resonator includes three or more of the line structures of substantially the same shape;

each of the line structures includes a first comb-like unit that has some of the resonance lines connected at end portions thereof in substantially a parallel fashion by the connection line, and a second comb-like unit that has the other lines of the resonance lines connected at end portions thereof in substantially a parallel fashion by the connection line, the connection line having a bent portion between the first comb-like unit and the second comb-like unit; and the line structures are combined in such a manner that one of the comb-like units of one of the line structures faces one of the comb-like units of another one of the line structures, and the resonance lines of one of the line structures and the resonance lines of the another one of the line structures are alternately located.

4. The resonator according to claim 1, wherein end portions of the resonance lines not connected to the connection line are T-shaped.

5. The resonator according to claim 1, wherein the resonator lines and the connection line are made of a superconducting material.

6. A filter comprising the resonator according to claim 1.

* * * * *